US010358737B2

(12) United States Patent
Sullivan et al.

(10) Patent No.: US 10,358,737 B2
(45) Date of Patent: Jul. 23, 2019

(54) METHODS AND SYSTEMS FOR ELECTROPHORETIC DEPOSITION OF ENERGETIC MATERIALS AND COMPOSITIONS THEREOF

(71) Applicant: Lawrence Livermore National Security, LLC, Livermore, CA (US)

(72) Inventors: Kyle Sullivan, Pleasanton, CA (US); Alexander E. Gash, Brentwood, CA (US); Joshua Kuntz, Livermore, CA (US); Marcus A. Worsley, Hayward, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 703 days.

(21) Appl. No.: 14/711,729

(22) Filed: May 13, 2015

(65) Prior Publication Data

US 2015/0252489 A1 Sep. 10, 2015

Related U.S. Application Data

(62) Division of application No. 13/570,085, filed on Aug. 8, 2012, now Pat. No. 9,062,952.

(60) Provisional application No. 61/521,083, filed on Aug. 8, 2011.

(51) Int. Cl.

| | |
|---|---|
| ***C06B 45/14*** | (2006.01) |
| ***C25D 13/22*** | (2006.01) |
| ***F42C 19/08*** | (2006.01) |
| ***C06B 21/00*** | (2006.01) |
| ***C25D 13/12*** | (2006.01) |
| ***C25D 13/18*** | (2006.01) |

(52) U.S. Cl.

CPC ..... *C25D 13/22* (2013.01); *C06B 21/0083* (2013.01); *C06B 45/14* (2013.01); *C25D 13/12* (2013.01); *C25D 13/18* (2013.01); *F42C 19/0803* (2013.01)

(58) Field of Classification Search

CPC ..... C06B 45/14; C06B 21/00; C25D 13/22

See application file for complete search history.

(56) References Cited

U.S. PATENT DOCUMENTS

| | | | | |
|---|---|---|---|---|
| 3,666,967 | A | 5/1972 | Keister et al. | |
| 5,464,699 | A | 11/1995 | Baldi | |
| 9,062,952 | B2 | 6/2015 | Sullivan et al. | |
| 2005/0032362 | A1* | 2/2005 | Cohen | C25D 5/022 438/658 |
| 2006/0130302 | A1* | 6/2006 | Xu | H01L 27/20 29/25.35 |

(Continued)

OTHER PUBLICATIONS

Election/Restriction Requirement from U.S. Appl. No. 13/570,085, dated Aug. 28, 2014.

(Continued)

*Primary Examiner* — Aileen B Felton
(74) *Attorney, Agent, or Firm* — Zilka Kotab

(57) ABSTRACT

A method includes providing a plurality of particles of an energetic material suspended in a dispersion liquid to an EPD chamber or configuration; applying a voltage difference across a first pair of electrodes to generate a first electric field in the EPD chamber; and depositing at least some of the particles of the energetic material on at least one surface of a substrate, the substrate being one of the electrodes or being coupled to one of the electrodes.

20 Claims, 15 Drawing Sheets

(56) References Cited

U.S. PATENT DOCUMENTS

| | | | | |
|---|---|---|---|---|
| 2006/0258132 | A1* | 11/2006 | Brown | B82Y 10/00 438/610 |
| 2007/0131555 | A1* | 6/2007 | Thon | C25D 13/00 204/622 |
| 2007/0277914 | A1* | 12/2007 | Hugus | C06B 21/005 149/19.92 |
| 2009/0178741 | A1* | 7/2009 | Xun | C06B 45/14 149/15 |
| 2009/0211484 | A1 | 8/2009 | Truitt et al. | |
| 2010/0044236 | A1* | 2/2010 | Mayer | C23C 18/1601 205/80 |
| 2011/0083967 | A1* | 4/2011 | Ruan | C25D 3/66 205/238 |
| 2013/0036930 | A1 | 2/2013 | Sullivan et al. | |

OTHER PUBLICATIONS

Aumann et al., "Oxidation behavior of aluminum nanopowders," Journal of Vacuum Science and Technology 8, vol. 13, No. 3, 1995, pp. 1178-1183.

Besra et al., "A review on fundamentals and applications of electrophoretic deposition (EPD)," Progress in Materials Science, vol. 52, 2007, pp. 1-61.

Kim et al., "Enhancing the Rate of Energy Release from NanoEnergetic Materials by Electrostatically Enhanced Assembly," Advanced Materials, vol. 16, No. 20, 2004, pp. 1821-1825.

Malchi et al., "Electrostatically Self-Assembled Nanocomposite Reactive Microspheres," Applied Materials and Interfaces, vol. 1, No. 11, 2009, pp. 2420-2423.

Prentice et al., "Effect of Nanocomposite Synthesis on the Combustion Performance of a Ternary Thermite," J. Phys. Chem. B, vol. 109, No. 43, 2005, pp. 20180-20185.

Rossi et al., "Micropyrotechnics, a new technology for making energetic microsystems: review and prospective," Sensors and Actuators A, vol. 120, 2005, pp. 297-310.

Tappan, A.S., "Microenergetics: Combustion and Detonation At Sub-Millimeter Scales," Shock Compression of Condensed Matter, 2007, pp. 997-1002.

Wang, et al., "Room-temperature soldering with nanostructured foils," Applied Physics Letters, vol. 83, No. 19,2003, pp. 3987-3989.

Sullivan et al., "Electrophoretic deposition of binary energetic composites," Combustion and Flame, vol. 159, 2012, pp. 2210-2218.

Sullivan et al., U.S. Appl. No. 13/570,085, filed Aug. 8, 2012.

Election/Restriction Requirement from U.S. Appl. No. 13/570,085, dated Apr. 7, 2014.

Non-Final Office Action from U.S. Appl. No. 13/570,085, dated Jan. 7, 2015.

Notice of Allowance from U.S. Appl. No. 13/570,085, dated May 14, 2015.

* cited by examiner

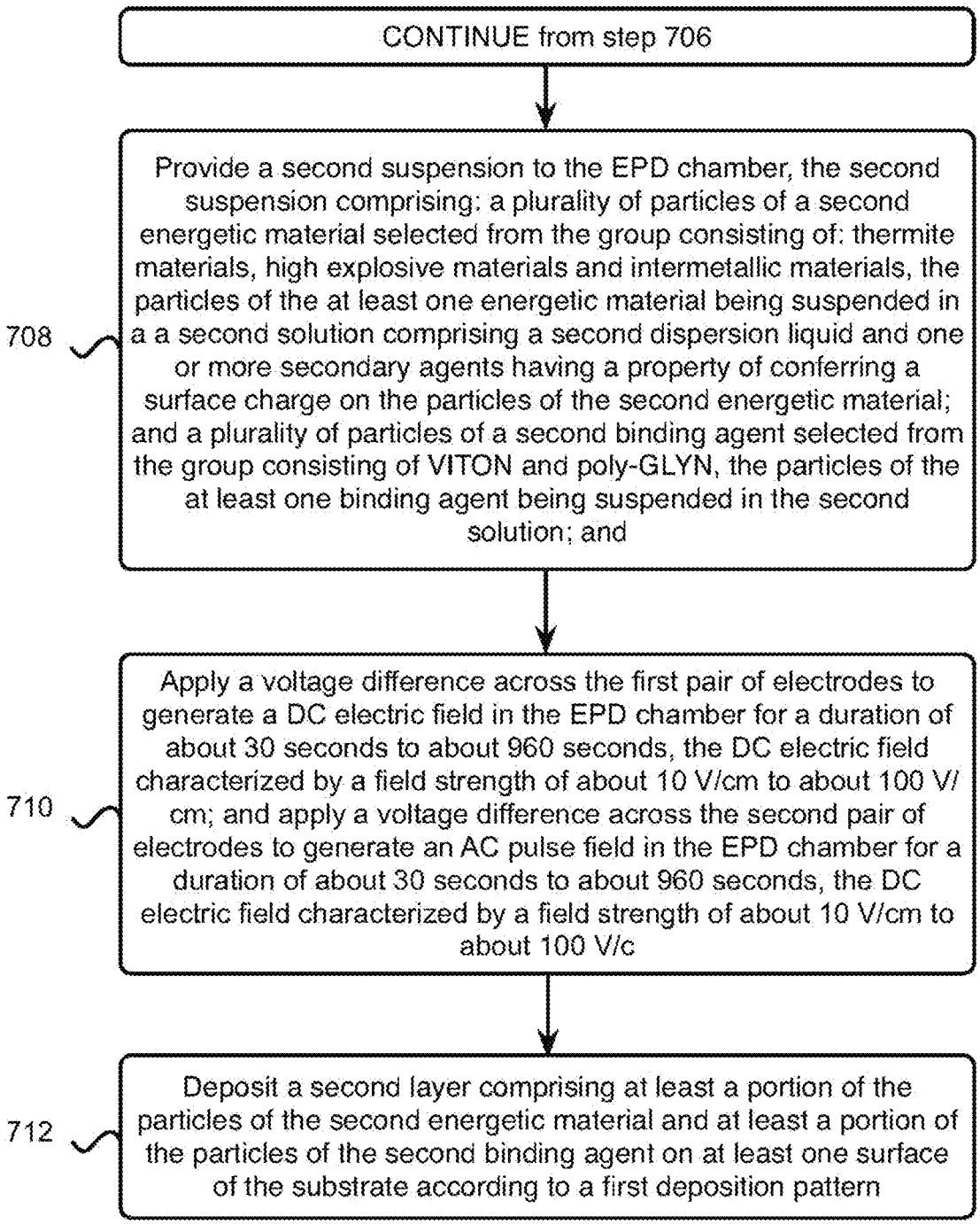
FIG. 7 (contd.)

METHODS AND SYSTEMS FOR ELECTROPHORETIC DEPOSITION OF ENERGETIC MATERIALS AND COMPOSITIONS THEREOF

RELATED APPLICATIONS

This application is a divisional of U.S. patent application Ser. No. 13/570,085, filed on Aug. 8, 2012, and claims priority to U.S. Provisional Patent Application No. 61/521,083 filed on Aug. 8, 2011, which are herein incorporated by reference.

The United States Government has rights in this invention pursuant to Contract No. DE-AC52-07NA27344 between the United States Department of Energy and Lawrence Livermore National Security, LLC for the operation of Lawrence Livermore National Laboratory.

FIELD OF THE INVENTION

The present invention relates to compositions containing energetic materials, and more particularly, to using electrophoretic deposition in at least one synthesis step to produce the desired energetic formulation.

BACKGROUND

The electrophoretic deposition (EPD) process utilizes electric fields to mobilize particles within a solution or suspension and deposit those particles from a solution onto a substrate by taking advantage of particle surface charge.

Earlier industrial use of EPD processes has been applied to a broad range of materials, but owing at least in part to the hazardous and sensitive nature of constructing products containing energetic materials, such as high explosives, thermites, and intermetallic compounds, as well as regulations restricting the use and creation thereof, EPD processes have yet to be applied to creating products including compositions of energetic materials.

However, the ability to construct products containing compositions of energetic materials with precision and accordingly provide highly controlled and/or tunable combustion behavior on a wide range of substrates would provide great benefits and new applications in national defense, materials research, pyrotechnics, welding, mining, and the like by conferring unprecedented flexibility and precision in designing products suitable for use in such applications.

SUMMARY

In one embodiment, a method includes providing a plurality of particles of an energetic material suspended in a dispersion liquid to an EPD chamber or configuration; applying a voltage difference across a first pair of electrodes to generate a first electric field in the EPD chamber; and depositing at least some of the particles of the energetic material on at least one surface of a substrate, the substrate being one of the electrodes or being coupled to one of the electrodes.

In another embodiment, a method includes providing a suspension to an EPD chamber or configuration, the suspension including: a plurality of particles of an energetic material selected from the group consisting of: thermite materials, high explosive materials and intermetallic materials, the particles of the at least one energetic material being suspended in a solution including a dispersion liquid and one or more secondary agents having a property of conferring a surface charge on the particles of the energetic material; a plurality of particles of a binding agent selected from the group consisting of VITON and poly-GLYN, the particles of the at least one binding agent being suspended in the solution; and applying a voltage difference across a first pair of electrodes to generate a DC electric field in the EPD chamber for a duration of about 30 seconds to about 960 seconds, the DC electric field characterized by a field strength of about 1,000 V/m to about 10,000 V/m and; applying a voltage difference across a second pair of electrodes to generate an AC pulse field for a duration in the range from about 30 seconds to about 960 seconds, the AC pulse field characterized by a field strength of about 10 V/cm to about 100V/cm and; depositing a first layer including at least a portion of the particles of the energetic material and at least a portion of the particles of the binding agent on at least one surface of the substrate according to a first deposition pattern; providing a second suspension to the EPD chamber, the second suspension including: a plurality of particles of a second energetic material selected from the group consisting of: thermite materials, high explosive materials and intermetallic materials, the particles of the at least one energetic material being suspended in a second solution including a second dispersion liquid and one or more secondary agents having a property of conferring a surface charge on the particles of the second energetic material; and a plurality of particles of a second binding agent selected from the group consisting of VITON and poly-GLYN, the particles of the at least one binding agent being suspended in the second solution; and applying a voltage difference across the first pair of electrodes to generate the DC electric field in the EPD chamber for a duration in the range from about 30 seconds to about 960 seconds, the DC electric field characterized by a field strength of about 1,000 V/m to about 10,000 V/m and; applying a voltage difference across the second pair of electrodes to generate the AC pulse field for a duration in the range from about 30 seconds to about 960 seconds, the AC pulse field characterized by a field strength of about 10 V/cm to about 100V/cm; and depositing a second layer including at least a portion of the particles of the second energetic material and at least a portion of the particles of the second binding agent on at least one surface of the substrate according to a second deposition pattern; where a first line intersecting the first electrode and the second electrode is substantially perpendicular to a second line intersecting the third electrode and the fourth electrode, where generating the first electric field is performed simultaneous to generating the second electric field, and where generating the first electric field and generating the second electric field simultaneously comprises generating electric fields having substantially perpendicular axes of orientation.

Other aspects and embodiments of the present invention will become apparent from the following detailed description, which, when taken in conjunction with the drawings, illustrate by way of example the principles of the invention.

DETAILED DESCRIPTION

Figure 1A:
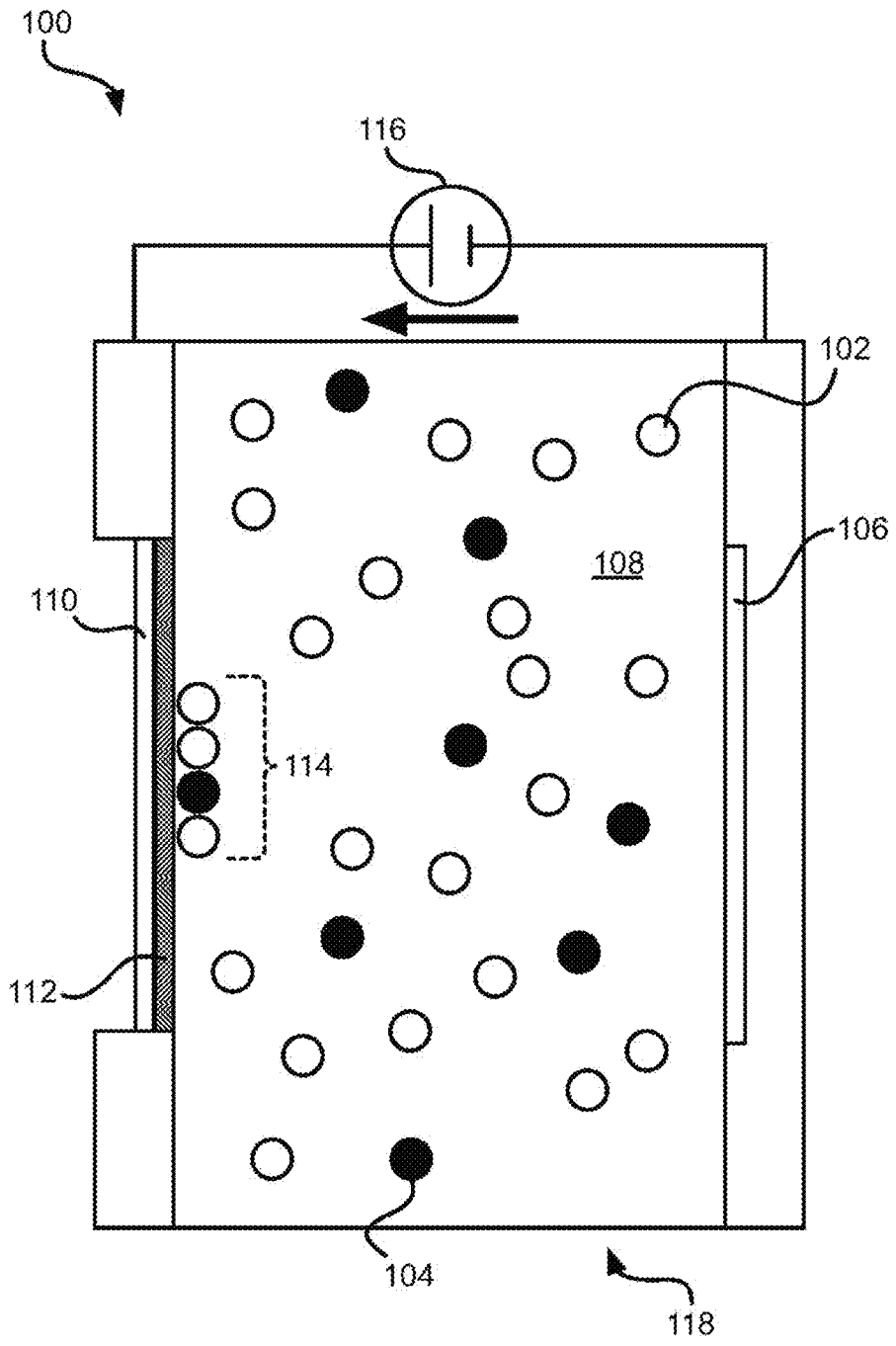
FIG. 1A is a simplified schematic diagram of an electrophoretic deposition (EPD) device, according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an," and "the" include plural referents unless otherwise specified.

In one general embodiment, a product includes: a part including at least one component characterized as an energetic material, where the at least one component is at least partially characterized by physical characteristics of being deposited by an electrophoretic deposition process. The at least one component may be or include a film. As used herein, a "film" may include any configuration of material deposited by an EPD process, including a strip, wire, tape, filled region e.g., of a substrate, etc. In some embodiments, the at least one component may include at least two subcomponents, such as a fuel and oxidizer, explosive and binder, etc.

In another general embodiment, a method includes providing a plurality of particles of an energetic material suspended in a dispersion liquid to an EPD chamber or configuration; applying a voltage difference across a first pair of electrodes to generate a first electric field in the EPD chamber; and depositing at least some of the particles of the energetic material on at least one surface of a substrate, the substrate being one of the electrodes or being coupled to one of the electrodes.

In still another general embodiment, a method includes providing a suspension to an EPD chamber or configuration, the suspension including: a plurality of particles of an energetic material selected from the group consisting of: thermite materials, high explosive materials and intermetallic materials, the particles of the at least one energetic material being suspended in a solution including a dispersion liquid and one or more secondary agents having a property of conferring a surface charge on the particles of the energetic material; a plurality of particles of a binding agent selected from the group consisting of VITON and poly-GLYN, the particles of the at least one binding agent being suspended in the solution; and applying a voltage difference across a first pair of electrodes to generate a DC electric field in the EPD chamber for a duration of about 30 seconds to about 960 seconds, the DC electric field characterized by a field strength of about 1,000 V/m to about 10,000 V/m and; applying a voltage difference across a second pair of electrodes to generate an AC pulse field for a duration in the range from about 30 seconds to about 960 seconds, the AC pulse field characterized by a field strength of about 10 V/cm to about 100V/cm and; depositing a first layer including at least a portion of the particles of the energetic material and at least a portion of the particles of the binding agent on at least one surface of the substrate according to a first deposition pattern; providing a second suspension to the EPD chamber, the second suspension including: a plurality of particles of a second energetic material selected from the group consisting of: thermite materials, high explosive materials and intermetallic materials, the particles of the at least one energetic material being suspended in a second solution including a second dispersion liquid and one or more secondary agents having a property of conferring a surface charge on the particles of the second energetic material; and a plurality of particles of a second binding agent selected from the group consisting of VITON and poly-GLYN, the particles of the at least one binding agent being suspended in the second solution; and applying a voltage difference across the first pair of electrodes to generate the DC electric field in the EPD chamber for a duration in the range from about 30 seconds to about 960 seconds, the DC electric field characterized by a field strength of about 1,000 V/m to about 10,000 V/m and; applying a voltage difference across the second pair of electrodes to generate the AC pulse field for a duration in the range from about 30 seconds to about 960 seconds, the AC pulse field characterized by a field strength of about 10 V/cm to about 100V/cm; and depositing a second layer including at least a portion of the particles of the second energetic material and at least a portion of the particles of the second binding agent on at least one surface of the substrate according to a second deposition pattern; where a first line intersecting the first electrode and the second electrode is substantially perpendicular to a second line intersecting the third electrode and the fourth electrode, where generating the first electric field is performed simultaneous to generating the second electric field, and where generating the first electric field and generating the second electric field simultaneously comprises generating electric fields having substantially perpendicular axes of orientation.

Materials

Energetic materials, as understood herein, include materials and composites falling under the classification of high explosives, thermites, intermetallics, etc. having properties substantially as discussed herein, as would be understood by one having ordinary skill in the art upon reading the present descriptions.

Additionally, energetic formulations often include both energetic and non-energetic materials, which, in some approaches may both be advantageous to yield the desired functionality and properties of the material. As such, EPD can be utilized to deposit at least one component of the formulation, so long as the final product comprises an energetic part, as would be understood by one having ordinary skill in the art upon reading the present descriptions. Additionally and/or alternatively, the synthesis of a final part may involve multiple steps, some of which do not utilize EPD. In one embodiment (e.g. as shown and described below in FIG. 4D), an aluminum lattice is synthesized by an alternate method. EPD may then used to fill the aluminum lattice with CuO, rendering a final energetic thermite part.

In particular, exemplary high explosive materials generally include energetic organic molecules, such as trinitrotoluene (TNT), substituted 2,6-diaminopyrazine-1-oxide (DAPO), 2,6-diamino-3,5-dinitropyrazine-1-oxide (LLM-105), 2-amino-6-(alkylamino)pyrazine, 2-amino-6-(arylalkylamino)pyrazine, 2,6-diaminopyrazine, 2-amino-6-arylaminopyrazine, 2-amino-6-alkoxypyrazine, 2-amino-6-arylalkylaminopyrazine, 2-amino-6-etheralkoxypyrazine, 2-amino-6-tertiaryaminoalkylalkoxypyrazine or 2-amino-6-aryloxypyrazine, etc. as would be understood by one having ordinary skill in the art upon reading the present descriptions.

Turning now to thermites, as understood herein a thermite is any compound including any fuel-oxide mixture characterized by a metal or metalloid fuel component and a metal-oxide or metalloid-oxide oxidizer component, where the metal or metalloid component of the fuel is of a different elemental identity than the metal or metalloid component of the oxidizer, e.g. Al—CuO, Al—$MoO_3$, Al—$Bi_2O_3$, Al—$Fe_2O_3$, B—CuO etc. as would be understood by one having ordinary skill in the art upon reading the present descriptions.

Exemplary fuels suitable for use in thermite mixtures include Al, Fe, Mo, Cu, Cr, Ti, Mn, Mg, Ta, W, Zn, Si, B, etc.

Exemplary oxidizers include $Bi_2O_3$, $Cu_2O$, CuO, $Fe_2O_3$, FeO, MnO, $MnO_2$, $MoO_3$, $WO_3$, etc.

In some approaches, where a thermite is employed as the energetic material, it is advantageous to co-deposit the metal component and the metal-oxide component. Accordingly, preferred embodiments employing a single thermite composition utilize a thermite composition wherein the metal component and metal-oxide component exhibit a substantially identical surface charge in suspension, so that each component experiences a substantially equal net influence in the presence of the electrical field(s), resulting in a substantially equal deposition rate and ensuring that the metal component and metal-oxide component are sufficiently distributed to facilitate a self-propagating reaction upon ignition. Moreover, in embodiments where a combination of thermite materials is employed as the energetic material, each component may be codeposited as described above. Additionally and/or alternatively, thermite materials, or single components of the thermite materials, may be deposited in a sequential manner to form the film structure of the resulting energetic material in the product. Additionally and/or alternatively, the concentrations of the components may be adjusted to urge codeposition towards some preferred ratio. Additionally and/or alternatively, secondary agents may be added to the suspension having the components to urge codeposition towards some preferred ratio.

In further embodiments, the thermite materials employed as the energetic material may be classified as nanothermites characterized by nano-scale particle size. In one embodiment, thermite particles having a diameter of approximately $10^{-7}$ m or less, e.g., $10^{-7}$ to $10^{-9}$ m, may be utilized as the thermite material. As will be appreciated by one having ordinary skill in the art upon reading the present descriptions, embodiments utilizing nanothermite materials may exhibit a substantially increased combustion reaction rate, which may be advantageous in applications such as ordinance manufacturing and use, pyrotechnics, etc.

Now regarding intermetallic compounds suitable for use as energetic materials according to the present descriptions, an intermetallic compound is any compound characterized as a metal-metal or a metal-metalloid, where each of the two metals or the metal and metalloid, respectively, are of different elemental classifications. For example, suitable intermetallic compounds for use as energetic materials according to the present descriptions include compounds comprising two or metals selected from Al, Ga, In, Tl, Sn, Pb, Ni, Pd, Ti, etc. as would be understood by one having ordinary skill in the art upon reading the present descriptions.

Moreover, suitable intermetallic compounds for use as energetic materials according to the present descriptions include compounds comprising a metal such as from Al, Ga, In, Tl, Sn, Pb, Ni, Pd, Ti, etc. and a metalloid such as Si, Ge, As, Sb, Te, B, etc. Several exemplary energetic materials comprising intermetallics include $Cu_3Sn$, $TiSi_2$, $Ni_3Al$, NiAl, $TiB_2$, etc. as would be understood by one having ordinary skill in the art upon reading the present descriptions. Additionally and/or alternatively, reactions such as $2Ti+B_4C \rightarrow 2TiB_2+C$ are also considered in this material set, due to the fact that the energetic property is a result of the formation of intermetallic $TiB_2$, in another embodiment. As will be understood by one having ordinary skill in the art reading the present descriptions, other similar reactions may be utilized in generating materials suitable for EPD processing to fabricate energetic material composites without departing from the scope of the present disclosure.

Of course, additional energetic materials of classifications beyond high explosives, thermites, and intermetallics may be employed according to knowledge of energetic materials as possessed by skilled artisans in the field. An example of such a formulation is a metal fuel mixed with fluoropolymers (such as VITON, e.g. copolymers of hexafluoropropylene (HFP) and/or vinylidene fluoride (VDF), terpolymers of tetrafluoroethylene (TFE), VDF, and/or HFP, and/or specialties containing perfluoromethylvinylether (PMVE), TFE/Propylene, Ethylene/TFE/PMVE, etc.). Additionally and/or alternatively, mixtures of two or more energetic material types can be considered, such as explosives and thermites, or intermetallics with explosives, etc.

In addition to the energetic materials described above, composites suitable for deposition by an EPD process and use in relevant applications as described herein may further include additional compounds for facilitating particle binding, e.g. adhesion to the surface of an electrode and/or substrate and/or adhesion/cohesion to other particles in the composite. Additionally and/or alternatively, secondary agents can be added to tailor the energy release rate, such as adding inert diluents, such as $Al_2O_3$, in one embodiment.

In some approaches, the composites suitable for EPD and subsequent use in applications such as described herein may additionally include one or more binding agents adapted for facilitating adhesion of the energetic material(s) to a substrate, and/or facilitating adhesion and/or cohesion of energetic material particles to one another. In several embodiments, suitable binding agents may be inert, such as VITON fluoroelastomers. e.g. copolymers of hexafluoropropylene (HFP) and/or vinylidene fluoride (VDF), terpolymers of tetrafluoroethylene (TFE), VDF, and/or HFP, and/or specialties containing perfluoromethylvinylether (PMVE), TFE/Propylene, Ethylene/TFE/PMVE, etc. as would be understood by one having ordinary skill in the art upon reading the present descriptions.

In additional and/or alternative embodiments, binding agents may further and/or alternatively include KEL-F fluoropolymers, such as polyvinylfluoride (PFV), folyvinylidene fluoride (PVDF), polytetrafluoroethylene (PCTFE), perfluoroalkoxy polymers (PFA), fluorinated ethylene-propylene (FEP), polyethylenetetrafluoroethylene (EFTE), polyethylenechlorotrifluoroethylene (ECTFE), Perfluoroelastomers, Fluorocarbons such as chlorotrifluoroethylenevinylidenefluoride, Perfluoropolyether, Perfluorosulfonic acid, etc. as would be understood by one having ordinary skill in the art upon reading the present descriptions.

Additionally and/or alternatively, binding agents also may be energetic, such as glycidyl nitrate polymers (poly-GLYN), nitrated cyclodextrin polymers (poly-CDN), 3-nitratomethyl-3-methyloxetane polymers (poly-NIMMO), nitrated hydroxy-terminated polybutadiene (NHTPB), etc. as would be understood by one having ordinary skill in the art upon reading the present descriptions. In embodiments employing energetic binding agents, the binding agent may act to enhance and/or stabilize the flame velocity during combustion reactions.

Moreover still, composites suitable for deposition by EPD and use in relevant applications described herein may additionally and/or alternatively include secondary agents adapted for modifying electrochemical properties of the particles of the energetic material(s) upon suspension in a dispersion liquid. The primary advantage of including such secondary agents is to facilitate and/or confer electrophoretic mobility of the particles of the energetic material by conveying and/or tuning the surface charge of the particles. Exemplary secondary agents include salts, acids, bases, ions, etc. In operation, secondary agents may convey, modify and/or tune particle surface charge by any suitable means as understood by skilled artisans, such as by modifying solution pH, salt concentration, ion concentration, etc. as would be understood by one having ordinary skill in the art upon reading the present descriptions.

In some embodiments, particles automatically acquire a surface charge upon suspension in the dispersion liquid, and in others, particles of the energetic materials suspended in the dispersion liquid acquire a surface charge upon addition of one or more secondary agents and mixing of the secondary agent, energetic material particles, and dispersion liquid as discussed herein.

Mixing and suspension of energetic materials, binding agents, and/or secondary agents in a dispersion liquid may be achieved by any suitable means appreciable by skilled artisans upon reading the present descriptions, including stirring, shaking, vortexing, applying ultrasonic energy, etc. Mixing should be performed in any manner sufficient to suspend the energetic material particles in the dispersion liquid, and, while homogenous suspensions may confer advantages including enhanced deposition uniformity and/or efficiency, reduce deposition time necessary to achieve a particular deposition thickness, etc. as would be understood by one having ordinary skill in the art upon reading the present descriptions, the suspension need not be homogenous according to the present disclosure.

Dispersion liquids suitable for use within the scope of the present descriptions include any liquids capable of supporting a suspension of energetic material particles, binding agents, and/or secondary agents as described herein. In several exemplary approaches, suitable dispersion liquids include water, ethanol-water solutions (preferably having an approximate final ethanol concentration of 75%, i.e. 150 proof), methanol, acetonitrile, hexane, or mixtures of such solvents, etc. as would be understood by one having ordinary skill in the art upon reading the present descriptions.

As described herein, the suspensions for EPD may include ethanol-water solutions, buffer solutions such as EDTA, PBS, PBST, etc. particles of energetic materials, binding agents, and/or secondary agents, in some approaches.

According to one exemplary approach, an approximately 3:1 volumetric ratio of ethanol:water ($EtOH:H_2O$) solution containing a total solids loading of approximately 0.2 vol % is used. In additional and/or alternative approaches, particles may be added to an ethanol solution and mixed prior to adding water, in order to avoid undesirable oxidation of metal and/or metalloid components of the energetic particles, as would be understood by one having ordinary skill in the art upon reading the present descriptions.

According to the materials and techniques presently described, in some approaches a film of energetic material may be characterized by a thickness in the range of about $10^{-6}$ meters to about $10^{-1}$ meters (or higher or lower), accomplished by employing a suspension loaded with approximately 0.2 vol %-1 vol % solids (i.e. particles), an electric field characterized by a field strength of about 1000 V/m to about 6000 V/m and a deposition time in the range from about 30 seconds to about 960 seconds.

In general, the achievable thickness is dependent upon parameters such as the identity of the substrate material and the energetic material, the strength of the electric field applied during deposition, the deposition time, etc. but may be difficult to predict without attempting experiments to determine the optimum deposition conditions. However, one skilled in the art, upon reading the present descriptions, would be able to make such determinations for various materials via experimentation, without resorting to undue experimentation.

Accordingly, it is possible to codeposit materials of differing identity and/or composition provided that each material exhibits similar electrophoretic mobility and/or deposition behavior, enabling synthesis of complex combinations of energetic materials and/or binding agents, in various embodiments.

EPD Devices

Turning now to the Figures, as shown in FIG. 1A, an EPD device 100 may include a first electrode 110 and a second electrode 106 positioned on either side of an EPD chamber 118, with a voltage difference 116 applied across the two electrodes 106, 110 that causes charged nanoparticles 102 and/or particles 104 in a suspension 108 to move toward the first electrode 110 as indicated by the arrow. In some embodiments, a substrate 112 (e.g. a conductive substrate, a nonconductive substrate coupled to a conductive electrode, a nonconductive substrate platted with a conductive substance, etc.) may be placed on a solution side of the first electrode 110 such that nanoparticles 114 may collect thereon. Thus, in one approach, a product may include a primarily nonconductive substrate having a conductive portion upon which at least one energetic material component is electrophoretically deposited.

In another approach, the product may include a nonconductive structure, where at least one energetic material component is positioned in and/or around the structure. The structure may or may not be functional to participate in an energetic reaction of the at least one component.

The EPD device 100, in some embodiments, may be used to deposit energetic materials on or above the first electrode 110 or a conductive substrate 112 positioned on a side of the electrode 110 exposed to a dispersion 108 including the energetic material 102 in suspension, 104 to be deposited. By controlling certain characteristics of formation of structures in an EPD process, such as the precursor material composition (e.g., homogenous or heterogeneous nanoparticle solutions) and orientation (e.g., non-spherical nanoparticles), deposition rates (e.g., by controlling an electric field strength, using different solvents, etc.), particle self-assembly (e.g., controlling electric field strength, particle size, particle concentration, temperature, etc.), material layers and thicknesses (e.g., through use of an automated sample injection system and deposition time), and deposition patterns with each layer (e.g., via use of dynamic electrode patterning), intricate and complex structures may be formed using EPD processes that may include a plurality of densities, microstructures, and/or compositions, according to embodiments described herein.

Figure 1B:
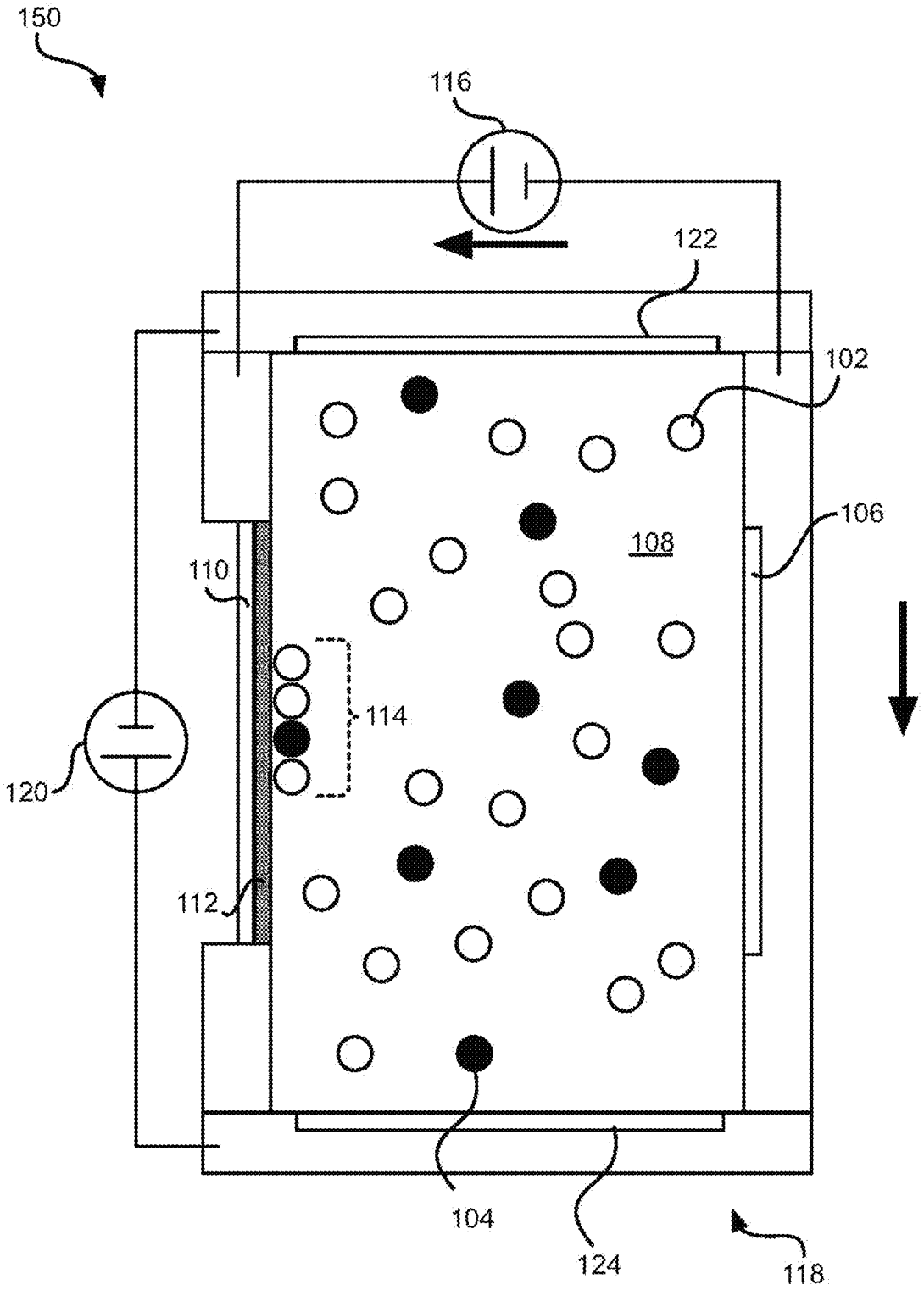
FIG. 1B is a simplified schematic diagram of an electrophoretic deposition (EPD) device, according to one embodiment.

Now regarding FIG. 1B, an EPD device 150 substantially identical to the EPD device 100 shown in FIG. 1A is shown as a simplified schematic, according to one embodiment. EPD device 150 includes all components as described above regarding EPD device 100, and additionally includes a second voltage difference 120 applied across electrodes 122, 124 which influences the movement of particles 102 and/or 104 in the suspension 108. The precise influence on the movement of particles 102 and/or 104 depends on the type of field generated (e.g. alternating current (AC), direct current (DC), constant, pulse, etc.), the strength of the field, and the duration of application, as will be understood by persons having ordinary skill in the art upon reading the present descriptions. Of course, additional electrodes may be included in EPD devices according to the present descriptions in various locations in and/or around the EPD chamber, such as above and/or below the plane of the images depicted in FIGS. 1A and 1B, among other positions.

Other components and/or resulting products shown in FIGS. 1A-5B of the EPD devices 100, 150 not specifically described herein may be chosen, selected, and optimized according to any number of factors, such as size limitations, power requirements, formation time, etc., as would be known by one of skill in the art upon reading the present disclosure.

In another approach, the substrate and/or electrode may have a non-planar shape, e.g., it is cylindrical, polygonal, conical, etc., as will be described in more detail in reference to FIGS. 3A-3C.

Figure 3C:
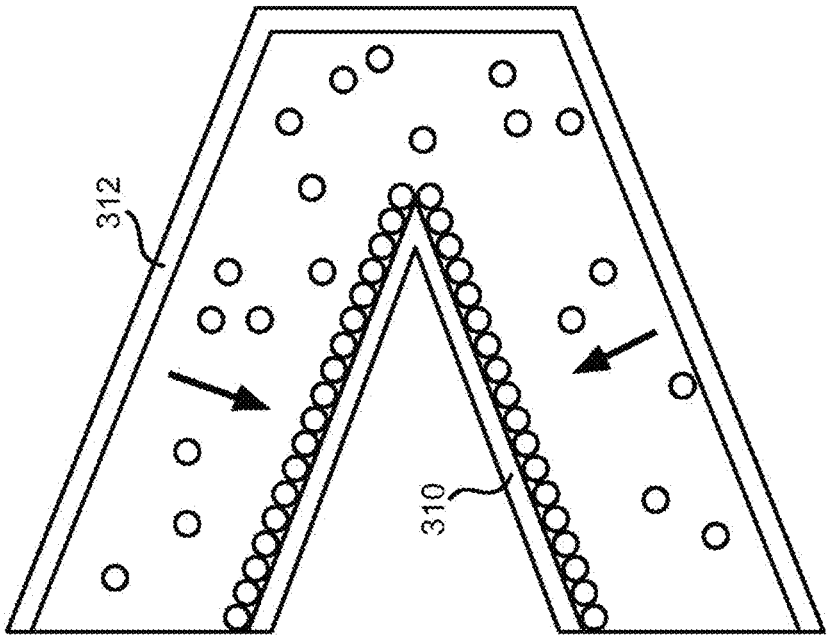
FIGS. 3A-3C show several exemplary electrode configurations for EPD, according to various embodiments.
Figure 3B:
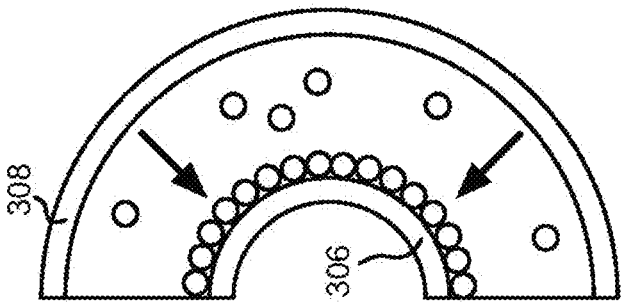
Figure 3A:
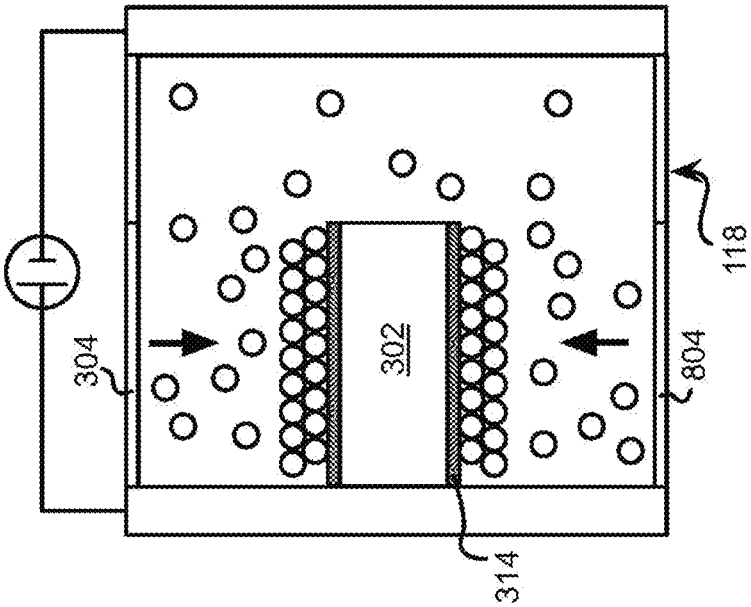

FIGS. 3A-3C show electrode configurations for EPD, according to various embodiments. In FIG. 3A, an EPD device is shown with a non-planar electrode configuration. As can be seen, the first electrode 302 extends from an end of the EPD chamber 118, while the second electrode 304 is positioned apart from the first electrode 302 at a substantially equal distance, thereby providing an electric field to cause deposition when a voltage difference is applied across the electrodes 302, 304. In this or any other embodiment, the first electrode 302 may have a circular profile, a polygonal profile, a curved profile, etc. The shape of the first electrode 302 may be chosen to correspond to a desired shape of the deposited material and subsequent structure formed therefrom in some embodiments. In some embodiments, as shown in FIG. 3A, a layer 314 may be positioned between the first electrode 302 and the second electrode 304, which may be a conductive layer, a substrate, a coating, etc., as previously described.

Now referring to FIG. 3B, the first electrode 306 may comprise a curved surface according to one embodiment, with the second electrode 308 being positioned at substantially a constant distance apart, thereby providing a more uniform electric field upon application of a voltage difference between the electrodes 306, 308. The first electrode 306 may have a continuously curved surface, or may have portions thereof that are curved, with other portions planar or flat, according to various embodiments.

As shown in FIG. 3C, according to another embodiment, the first electrode 310 may have a conical surface, which may have a circular or polygonal profile, with the second electrode 312 being positioned at about a constant distance apart.

Of course, FIGS. 3A-3C are exemplary electrode configurations, and any combination of curved, flat, circular, polygonal, or any other shape as known in the art may be used for electrode design, particularly in an attempt to adhere to application requirements, as described herein. The invention is not meant to be limited to the electrode configurations described herein, but may include electrode configurations of any type as would be understood by one of skill in the art upon reading the present descriptions. For example, deposition may be performed onto the reverse electrodes 304 (FIG. 3A), 308 (FIG. 3B), 312 (FIG. 3C), respectively.

Figure 4A:
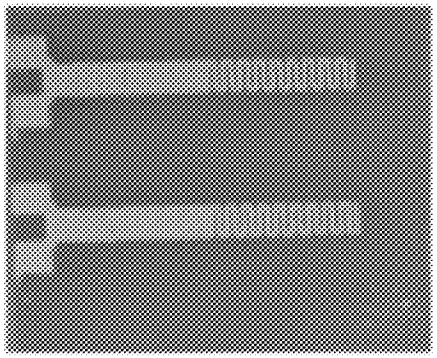
FIG. 4A depicts a potential planar deposition pattern suitable for use in EPD processes, according to one embodiment.
Figure 4B:
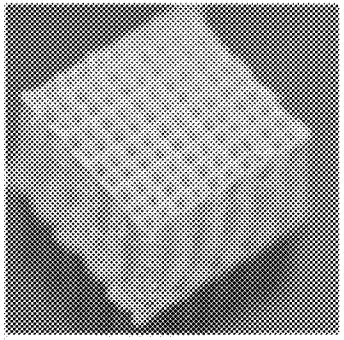
FIG. 4B shows one embodiment of a porous conductive substrate for use in EPD processes, according to one embodiment.
Figure 4C:
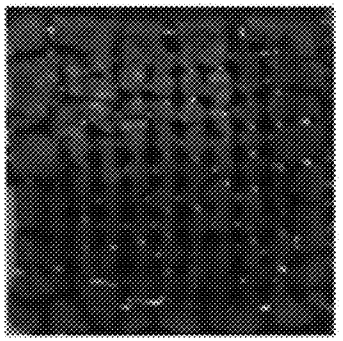
FIG. 4C shows the substrate represented in FIG. 4B, having particles of an energetic material deposited thereon after performing an EPD process, according to one embodiment.

In some embodiments the substrate may comprise an electrode, and in preferred embodiments may comprise a patterned electrode such as shown in FIGS. 4A, and 4B. In one embodiment, the substrate may be characterized as a planar substrate such as shown in FIG. 4A, while in another embodiment the substrate may be characterized as a non-planar substrate, such as a silver lattice, which is shown in FIG. 4B. In even further embodiments, the substrate may be a porous structure, including porous nanostructures such as porous silicon, carbon aerogel, etc. (not shown), so long as the structures are, or can be made, conductive.

In some embodiments, EPD may be used to deposit at least one component of an energetic formulation into a structure which, itself, may not necessarily be the conductive electrode, but which facilitates conferring properties of energetic materials on the resulting product. The structure may be made out of one or more components of an energetic compound, such as a fuel, an oxidizer, a binding agent, etc.

Figure 4D:
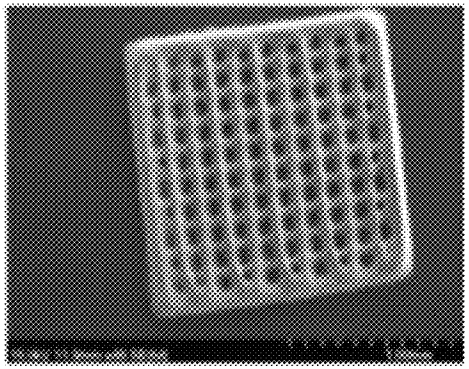
FIG. 4D shows one embodiment of a porous non-conductive substrate made out of a fuel, in which EPD is used to fill the oxidizer to produce an energetic composite.
Figure 4E:
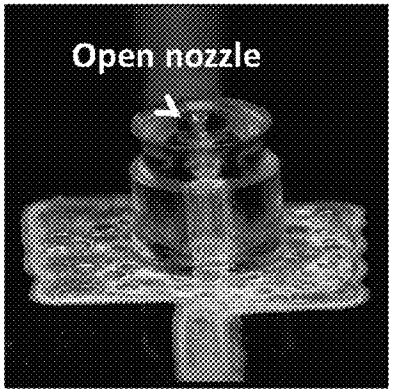
FIG. 4E shows one embodiment of an open non-conductive substrate which acts as a container.

In one embodiment, shown in FIG. 4E, a structure resembling a small nozzle may be synthesized by an alternate technique, and is affixed to a conductive electrode. EPD is then performed to precisely fill the structure with an energetic formulation.

In a preferred embodiment, a lattice-type structure may be made out of a fuel, of which an example is shown in FIG. 4D. The lattice is then affixed to a conductive electrode, and EPD is performed to fill the oxidizer (i.e. CuO) into the structure, thus making a thermite part in which the structure serves as a reactive component. The structure may also not be an energetic component, but may exist as a container or support structure which, in turn, enables the desired energetic functionality.

In one embodiment, a lattice may then be affixed to a conductive electrode, and EPD may be performed to fill the oxidizer (e.g. CuO) into the structure, thus making a thermite part. In one approach a structure as shown in FIG. 4D may comprise a fuel such as an aluminum lattice which, can be filled with an oxidizer such as CuO using EPD to render an ordered composite. Of course, other fuel/oxidizer combinations and/or other energetic material compositions may be employed in alternative and/or additional approaches, as would be appreciated by the skilled artisan upon reading the present descriptions.

In one embodiment, EPD can be used to deposit an energetic film onto a functional device, such as an exploding bridge wire, to enhance or modify the performance of the functional device. For example, an exploding bridge wire may be useful for coupling nonadjacent explosive charges in a daisy chain configuration. The energetic film may increase reaction rate, fidelity, reproducibility, etc. of the functional device.

As will be understood by the skilled artisan upon reading the present descriptions, substrates suitable for EPD as described herein include conductive substrates, non-conductive substrates coupled to a conductive electrode, and/or nonconductive substrates plated with a conductive material, and in some approaches may be chosen without regard to surface roughness, i.e. the presently described EPD processes may be successfully performed using substrates with extremely smooth surfaces or with substantial surface roughness. For example, in one embodiment the substrate may be a silicon wafer having an intermediate layer of chromium deposited thereon, and a layer of platinum disposed above the chromium intermediate layer. In additional and/or alternative embodiments, further exemplary substrate materials suitable for EPD include substrates comprising indium tin-oxide (InSnO) and substrates formed from a silver (Ag) nanoparticle paste formed into a filamentous substrate, etc.

In yet another approach, a nonconductive substrate may be coated with a thin film of conductive material, such as gold, nickel, platinum, etc., as known in the art, in order to confer conductivity on the substrate and allow non-planar deposition thereupon. In this manner, virtually any substrate may be subjected to specialized modification and/or coating using the EPD methodology.

Properties of Energetic Material Products Produced by EPD

Notably, the products producible by employing the presently described EPD process(es) include a composite of particles of energetic materials having physical characteristics of being formed by an EPD process. Such characteristics include, but are not limited to deposition conformal to a surface of a substrate, a tuned volumetric thermal energy density, highly precise film thickness, particle packing density, particle orientation, deposition pattern (2D or 3D), tuned linear flame velocity, tuned thermal conductivity (e.g. to the substrate), tuned flame propagation velocity, etc. as would be understood by one having ordinary skill in the art upon reading the present descriptions. In preferred embodiments, each physical characteristic may be selected and/or customized by tuning reaction conditions.

Notably, experimental evaluation of energetic materials formed by EPD processes generally exhibit substantially improved self-propagating reactions and linear flame propagation velocities upon ignition, particularly in embodiments where the optimal equivalence ratio (defined below) is achieved and employed, as will be understood by one having ordinary skill in the art upon reading the present descriptions. In the case of thermites, the improved reactivity is at least partially attributed to the more homogeneous and improved mixing, and thus interfacial contact, between the constituents.

The equivalence ratio of products produced by EPD processes is highly important, as it is highly relevant to combustion efficiency and behavior. As understood herein, the equivalence ratio of a compound is defined as the molar ratio of fuel to oxidizer relative to that in the stoichiometric reaction, as expressed in the following relationship, where F is the molar amount of fuel and O is the molar amount of oxidizer present in the compound:

$$\Phi = \frac{(F/O)_{actual}}{(F/O)_{stoich}} \qquad \text{Equation 1}$$

Since EPD confers the ability to control the deposition of both fuel and oxidizer components, it enables reproducible production of materials exhibiting an equivalence ratio very close to an optimal equivalence ratio, and therefore enables creation of highly controllable energetic materials, in some approaches.

Figure 2A:
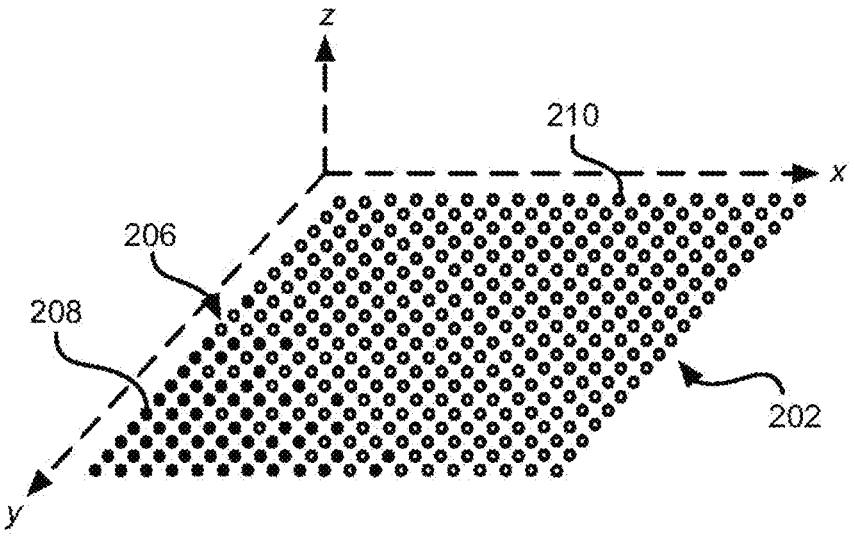
FIGS. 2A-2C show a simplified view of layers of a structure formed through an EPD process, according to one embodiment.
Figure 2B:
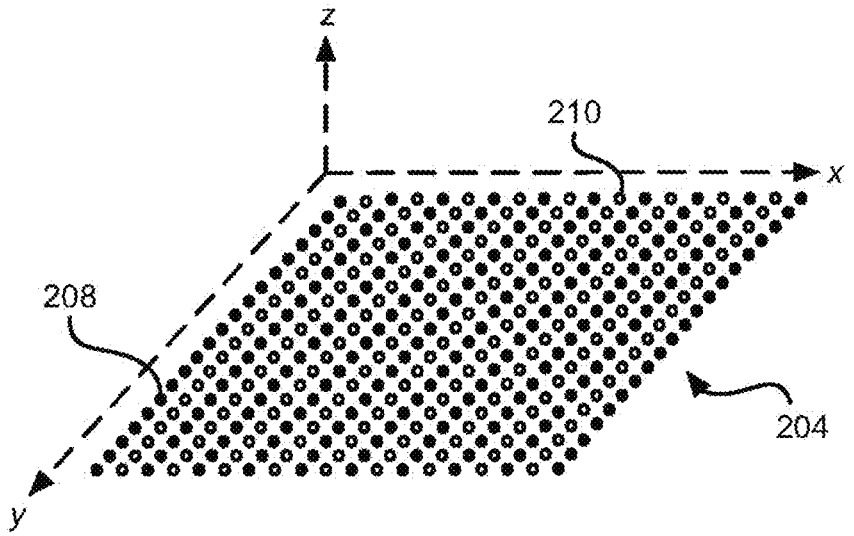
Figure 2C:
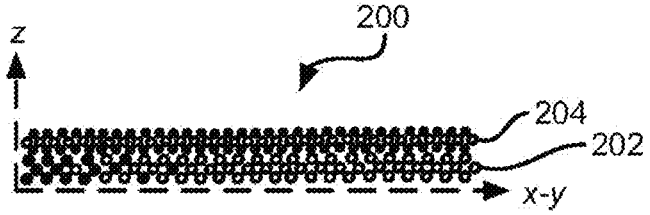

Now referring to FIGS. 2A-2C, according to one embodiment, an energetic material 200 comprises a first layer 202 oriented in an x-y plane of deposition.

As shown in FIG. 2A, the x-y plane is represented in an isometric view of a simplified schematic diagram of a single layer 202, which is represented by a plurality of white dots 210 and/or black dots 208. The dots 210 and/or 208 may represent a density of the layer (such as the black dots 208 representing a more dense volume, with the white dots 210 representing a less dense volume), a composition of the layer (such as the black dots 208 representing a first material, e.g. an energetic material, and the white dots 210 representing a second material, e.g. a binding agent and/or second energetic material), a microstructure of the layer (such as the black dots 208 representing a first lattice structure, with the white dots 210 representing a second lattice structure), etc. as would be understood by one having ordinary skill in the art upon reading the present descriptions.

Of course, the embodiments described herein are not meant to be limiting on the invention in any way. Also, the patterns are not limited to those shown in FIGS. 2A and 2B, and may include any shape (polygonal, regular, irregular, etc.), repeating pattern (single pixels, lines, shapes, areas, etc.), random array (e.g., a predefined composition of materials with a random arrangement, such as a 25%/75% material A/material B split, a 50%/50% material A/material B split, etc.), etc.

According to one embodiment, the gradient 206 of the first layer 202 may be defined by a first material 208 being arranged in a first pattern and a second material 210 being arranged in a second pattern, wherein the first pattern is complementary to the second pattern. The term "complementary" indicates that one pattern does not overlay the other pattern, but gaps may remain between the patterns where no material is deposited, in some approaches. In other approaches, the second pattern may be a reverse or negative pattern of the first pattern, e.g., red and black squares of a checker board. Of course, any pattern may be used for the first and second patterns as would be understood by one of skill in the art upon reading the present descriptions, including patterns that are not complementary. In more approaches, the patterns may be changed as material is deposited, causing even more options to material formation, layering, etc.

In another embodiment, at least the first material 208 and/or the first layer 202 may have a characteristic of being deposited through an EPD process according to the first pattern. This characteristic may include, in some embodiments, smooth, gradual gradients between the materials in the first layer 202, abrupt transitions from the first material 208 to the second material 210 in the first layer 202, regular patterning between the first material 208 and the second material 210, or any other characteristic of deposition through an EPD process as would be understood by one of skill in the art upon reading the present descriptions. In a further embodiment, at least the first material 208 may have a characteristic of being deposited through the EPD process above a non-planar electrode. For example, the non-planar electrode may have a cylindrical shape, a regular polygonal shape, a conical shape, a curved surface shape, or any other non-planar shape as would be understood by one of skill in the art upon reading the present descriptions. Non-planar electrodes are described in more detail later.

Of course, the patterns shown in FIGS. 2A-2C are not limiting on the invention in any way, and any patterns may be used as would be understood by one of skill in the art upon reading the present descriptions. In some approaches, the first, second, third, and/or fourth patterns may overlay one another and/or be coexistent therewith.

In another embodiment, at least the first material 208, the second material 210 and/or the second layer 204 may have a characteristic of being deposited through an EPD process according to one or more patterns. In a further embodiment, at least the first material 208, the second material 210 and/or the second layer 204 may have a characteristic of being deposited through the EPD process above a non-planar electrode, as described previously.

In another embodiment, each layer may employ one or more unique patterns and/or materials, thereby creating a structure which, in the z-direction perpendicular to the x-y plane, may have differing arrangements of materials.

As would be understood by one of skill in the art upon reading the present descriptions, in some embodiments one or more additional layers may be arranged above the first layer 202 and the second layer 204, thereby forming a structure that may have complex layering and/or composition.

In one embodiment, products incorporating energetic materials as described herein may include a thin film containing particles of one or more energetic materials, and the thin film may be disposed on one or more surfaces of a substrate. Importantly, the thin film of energetic materials incorporated into such products may preferably exhibit one or more physical characteristics of electrophoretic deposition, as discussed in detail above.

In additional and/or alternative embodiments, the film may further include one or more particle-binding agents for enhancing adhesion of the particles to one another and/or a substrate. Furthermore, the film may also include one or more secondary agents capable of modifying one or more properties of the energetic material in a liquid, and particularly a liquid suspension of the particles.

Thin films as described herein may be deposited on substrates to a thickness in the range of about $10^{-6}$ meters to about $10^{-1}$ meters, in another embodiment.

Figure 5B:
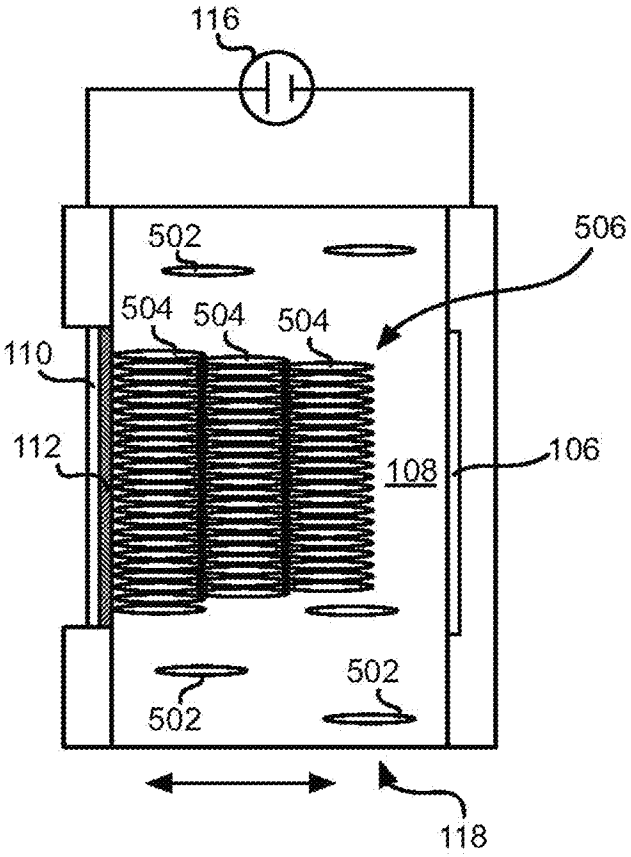
FIGS. 5A-5B show the formation of a highly ordered structure containing energetic materials through EPD, according to one embodiment.
Figure 5A:
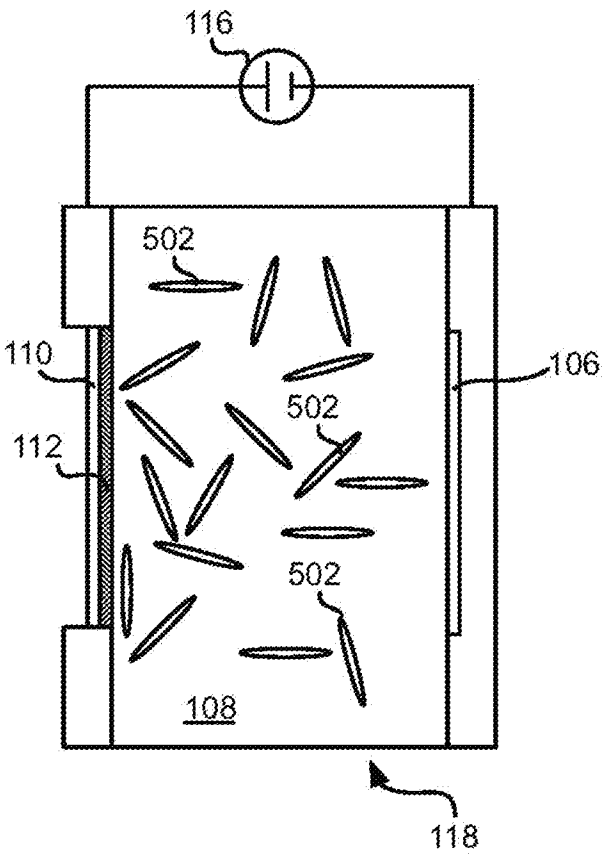

Now referring to FIGS. 5A-5B, an energetic material 506 having an elongated or rod-like shape, and a method of forming films thereof are shown according to various embodiments. FIG. 5A shows a condition when an electric field is not activated, and FIG. 5B shows a condition when the electric field is activated for a time.

Referring again to FIGS. 5A-5B, in one embodiment, the energetic material 506 comprises a plurality of layers 504 comprising particles 502. Each layer 504 is characterized by the particles 502 of the energetic material being aligned in a common direction, as indicated by the arrow in FIG. 5B when the electric field 116 is activated.

According to one embodiment, the plurality of layers 504 may have a characteristic of being deposited through an EPD process, as described previously. For example, alternating layers may be deposited to produce a laminate structure. In a further embodiment, the plurality of layers 504 may have a characteristic of being deposited through the EPD process above a non-planar electrode, as described above.

Methods of Fabrication

Materials and/or composites incorporating energetic materials as described herein may be fabricated using any suitable methodology, particularly including the methods described below.

Equation 2 sets out the basic system-level model for electrophoretic deposition according to one approach, where $W_{film}$ is the mass of the deposition layer, μ is the electrophoretic mobility, E is the electric field, A is the area of the electrode substrate, C is the deposition particle mass concentration, and t is the deposition time.

$$W_{film}=\int_{t1}^{t2}\mu EAC\,dt \qquad \text{Equation 2}$$

Combining these principles with dynamic patterning and sample delivery (which is described in more detail later), electrophoretic deposition may be employed to produce a diverse set of products with unique and/or difficult to obtain shapes, designs, and properties custom-fitted to any of a number of practical applications.

In one approach, EPD technology may be combined with pattern-oriented deposition in order to effectuate complex two- and three-dimensional patterning structures. In another approach, coordinating sample injection during EPD further enables complex patterning of structures that may include concentration gradients of a deposited material in complex two- and three-dimensional arrangements.

In another approach, multiple materials may be combined during patterning by way of coordinated sample injection in order to effectuate complex electrochemical and structural arrangements. By way of example, this approach may be employed to accomplish sample doping or to form compositions including multiple energetic materials for application in fields such as pyrotechnics, welding, mining, weapons development, etc. as would be understood by one having ordinary skill in the art upon reading the present descriptions.

Similarly, multiple dynamic patterns may be overlaid in combination with dynamic sample injection during the EPD process to generate a layered structure having differing arrangements, densities, microstructures, and/or composition according to any number of factors, including preferences, application requirements, cost of materials, etc.

Figure 6:
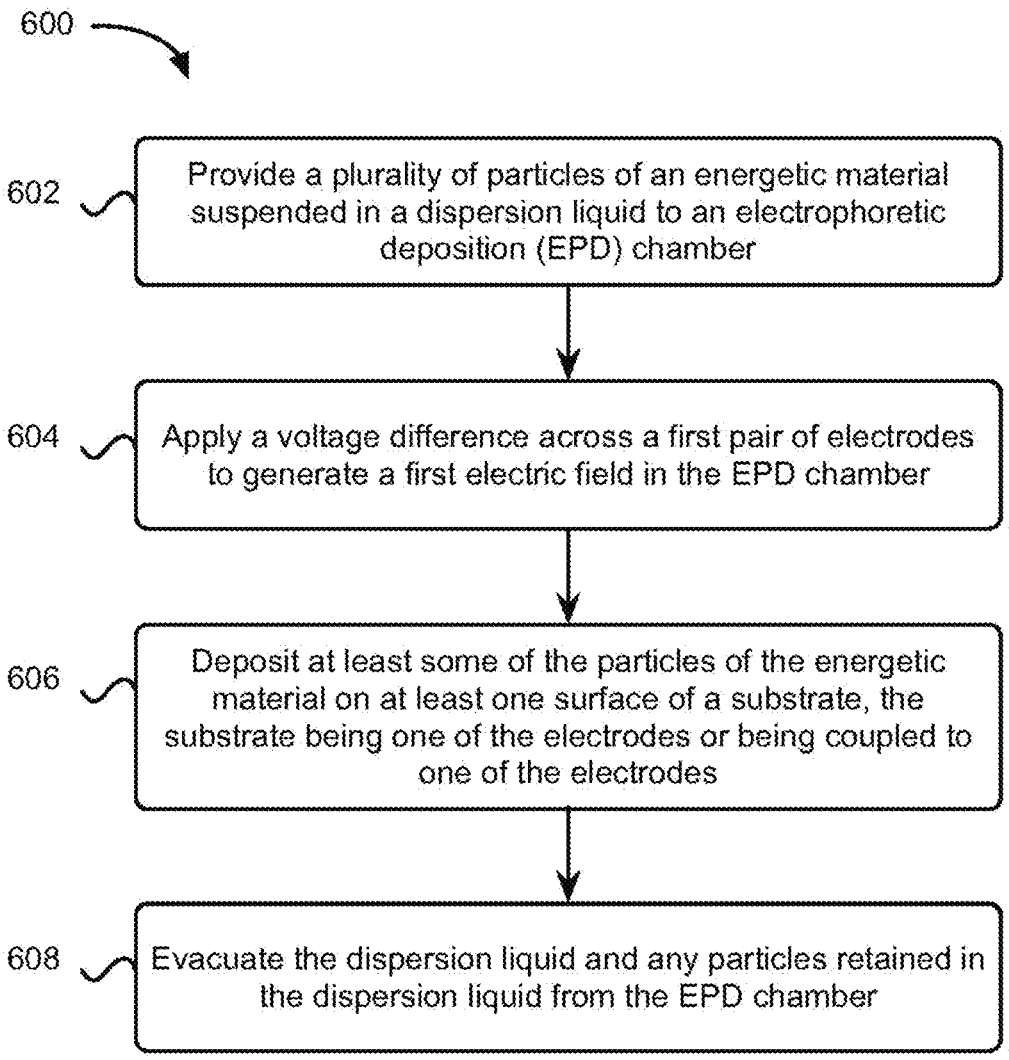
FIG. 6 shows a flowchart of a method, according to one embodiment.

Now referring to FIG. 6, a method 600 for forming a composite of energetic material is shown according to one embodiment. The method 600 may be carried out in any desired environment and/or used to create various composites, including those shown in FIGS. 1A-5B, among others.

In operation 602, a plurality of particles of an energetic material are provided to an electrophoretic deposition (EPD) chamber, the particles being suspended in a dispersion liquid according to one embodiment.

A voltage difference is applied across a first pair of electrodes in operation 604. Applying the voltage difference across the first pair of electrodes generates a first electric field in the EPD chamber, in one approach. In some approaches, the electrodes may be part of the EPD chamber, i.e. permanently integrated into the EPD chamber, or alternatively may be removable from the EPD chamber. In embodiments employing an EPD chamber with permanently integrated electrodes, at least one of the electrodes may be coupled to a substrate upon which the energetic material particles may deposit during electrophoresis, as discussed in detail below. In embodiments employing removable electrodes, the removable electrodes may serve as the substrate for deposition, or may be coupled to a substrate as described above for the case of permanently integrated electrodes.

Although any suitable electrophoresis conditions may be employed, in preferred embodiments the electric field is characterized by a field strength in the range from about 1,000 V/m to about 10,000 V/m, and in particularly preferred embodiments may be in the range from about 1,000 V/m to about 6,000 V/m (i.e. 10-60 V). In addition, the field is applied to the particles for a duration of about 30 sec to about 960 sec (16 min), in various approaches.

Electric fields generated to facilitate particle deposition as discussed herein may include direct-current (DC) fields, alternating-current (AC) fields, pulse fields, constant fields, etc. as would be understood by one having ordinary skill in the art upon reading the present descriptions. In some embodiments employing a pulse field, the pulse field may be characterized by a shaped pulse such as a substantially triangular shape, e.g. to facilitate particle orientation and/or deposition. Of course, in embodiments employing multiple electrode pairs, various field types may be employed in any suitable combination, and may be oriented in a variety of locations.

For example, with reference to FIG. 2A, in one exemplary embodiment where the axis of particle deposition is substantially aligned with the z-axis as shown in FIG. 2A, i.e. a pair of electrodes are located above and below the plane of particles 202, additional electrode pairs may be placed on opposite sides of the plane of particles 202 along the x and/or y axes, respectively, to generate additional fields resulting in a net influence on the particles in the EPD chamber during deposition. In particular, these additional electrode pairs may serve to facilitate particle deposition, deposition location, particle orientation, etc. as would be understood by one having ordinary skill in the art. Pulse fields are particularly effective to facilitate particle orientation, in some approaches.

Of course, the above example is not limiting on the disclosures presented herein, and electrodes may be positioned in any location in and/or around the EPD chamber to contribute to the net influence on particles in the chamber, as will be appreciated by skilled artisans reading the present descriptions.

In operation 606, some or all of the particles suspended in the dispersion liquid are deposited onto at least one surface of the substrate, whether the substrate is an electrode or another material coupled to the electrode. In some approaches, depositing the particles may be performed according to a deposition pattern, which may be defined by shaping the electrode and/or the substrate coupled to the electrode according to any desired shape or configuration. In one approach, the plurality of layers may be deposited above a planar electrode and/or a non-planar electrode.

Furthermore, in some approaches the deposition operation 606 may also include electrophoretically depositing one or more layers of particles of a second, different energetic material above the substrate, which can include depositing above and/or in the plane of the particles of the energetic material, above another surface of the substrate, etc., as would be understood by one having ordinary skill in the art upon reading the present descriptions.

Moreover, electrophoretically depositing the one or more layers of particles of the second energetic material may include electrophoretically depositing the particles of the second energetic material according to the deposition pattern utilized for depositing the previous layer of particles, or according to a different deposition pattern, according to some approaches.

In further approaches, fabrication of energetic materials via EPD processes may include depositing one or more components of an energetic material composite (e.g a fuel, an oxidizer, a binding agent, etc.) onto a substrate comprising one or more additional components of an energetic material. In one exemplary embodiment, fabrication may involve depositing an oxidizer via EPD onto a substrate comprising a fuel or fuel mixture. Of course, layers of energetic materials may also be constructed utilizing this component-based deposition approach, as would be understood by one having ordinary skill in the art upon reading the present descriptions.

In still more approaches, operation 606 may involve electrophoretically codepositing particles of two or more different energetic materials, which may or may not have been pre-mixed or pre-assembled. One commercially-available example is aluminum which has been electrolessly coated with nickel, thus yielding an energetic composite which can be deposited using EPD. Also, codepositing particles of one or more binding agent within the one or more types of particles of the energetic material on the substrate surface(s) may be performed. In processes including deposition of binding agent(s), particles of the binding agent may be suspended in the dispersion liquid along with the energetic material particles during deposition, for example in order to facilitate codeposition of binding agent and energetic particles. Alternatively, energetic material particles and binding agent particles may be deposited sequentially in order to form layers of each particle type above the substrate.

Next, in some approaches method 600 includes operation 608, where the dispersion liquid and any particles retained in the dispersion liquid are evacuated from the EPD chamber.

Preferably, the evacuation rate is set to ensure the deposited particles remain substantially deposited on the substrate surface(s) after evacuating the liquid from the EPD chamber, for example in one embodiment a rate of approximately 2 mL/min. In addition, in some embodiments curing processes such as thermal drying may be employed to facilitate complete removal of the suspension liquid after deposition of the energetic material. In still more embodiments, the withdrawal operation may include and/or be followed by one or more processes designed to enhance the physical properties of the energetic material favorable to desired combustion characteristics of the product, including sol-gel infiltration, e.g. using a resorcinol-formaldehyde sol-gel, and/or application of a carbon aerogel to the substrate surface(s).

In an alternate embodiment, rather than evacuating the dispersion liquid and any particles retained in the dispersion liquid from the EPD chamber the part may be removed from the dispersion bath.

Notably, washing the deposited particles and/or substrate is not necessary following evacuation, in most approaches, but may be performed to facilitate removal of the liquid in instances where evacuation is otherwise difficult, due to surface structure, chemistry of the dispersion solution and/or deposition surface, etc. as would be understood by one having ordinary skill in the art upon reading the present descriptions.

After performing the EPD process, the composite film may be removed from the EPD chamber. In one approach, the composite film is removed along with a substrate upon which it is formed, where the substrate can be any of the structures noted above, such as an electrode, a substrate positioned between the electrode and film, etc. In another approach, the composite film may be epoxyed or gelled, and then removed from the substrate. In yet another approach, a backing such as an adhesive tape may be applied to the composite film to assist in removal from the chamber and/or substrate while maintaining its structural integrity.

According to one approach, deposition patterns may cause the first layer to have a gradual or sudden gradient shift in composition, microstructure, and/or density in the x-y plane of the first layer, e.g., the gradient change varies across the first layer in the x-y plane, perhaps smoothly, abruptly, in small incremental steps, etc., as would be understood by one of skill in the art upon reading the present descriptions. In one approach, the pattern may gradually be shifted from the first pattern to the second pattern to form a smooth, gradual gradient in the layer.

In another embodiment, non-spherical particles may be aligned within an electrophoretic field using the direct current (DC) electrophoretic field and/or an alternating current (AC) electric field applied perpendicular to a plane of deposition and/or the DC electrophoretic field, the latter such as shown in FIG. 1B.

In this approach, upon deposition, the non-spherical particles may form a structure with highly aligned grains such as shown in FIG. 5B, discussed in detail above. In some embodiments, highly aligned grain orientation may increase thermal density, thus rendering useful ignition and combustion properties to the aligned structures.

For example, a method for forming an energetic material is described that may be carried out in any desired environment, including those shown in FIGS. 1, 3A-3C and 4A-4D, among others.

Referring again to FIGS. 5A and 5B, in one embodiment, a plurality of layers 504 of particles 502 of a non-cubic material are electrophoretically deposited as described previously. The particles 502 of the deposited non-cubic material are oriented in a common direction, as indicated by the arrow. The common direction may be related to a longitudinal direction of the particles 502, e.g., length of a cylinder, length of a rectangular polygon, etc.

Figure 7:
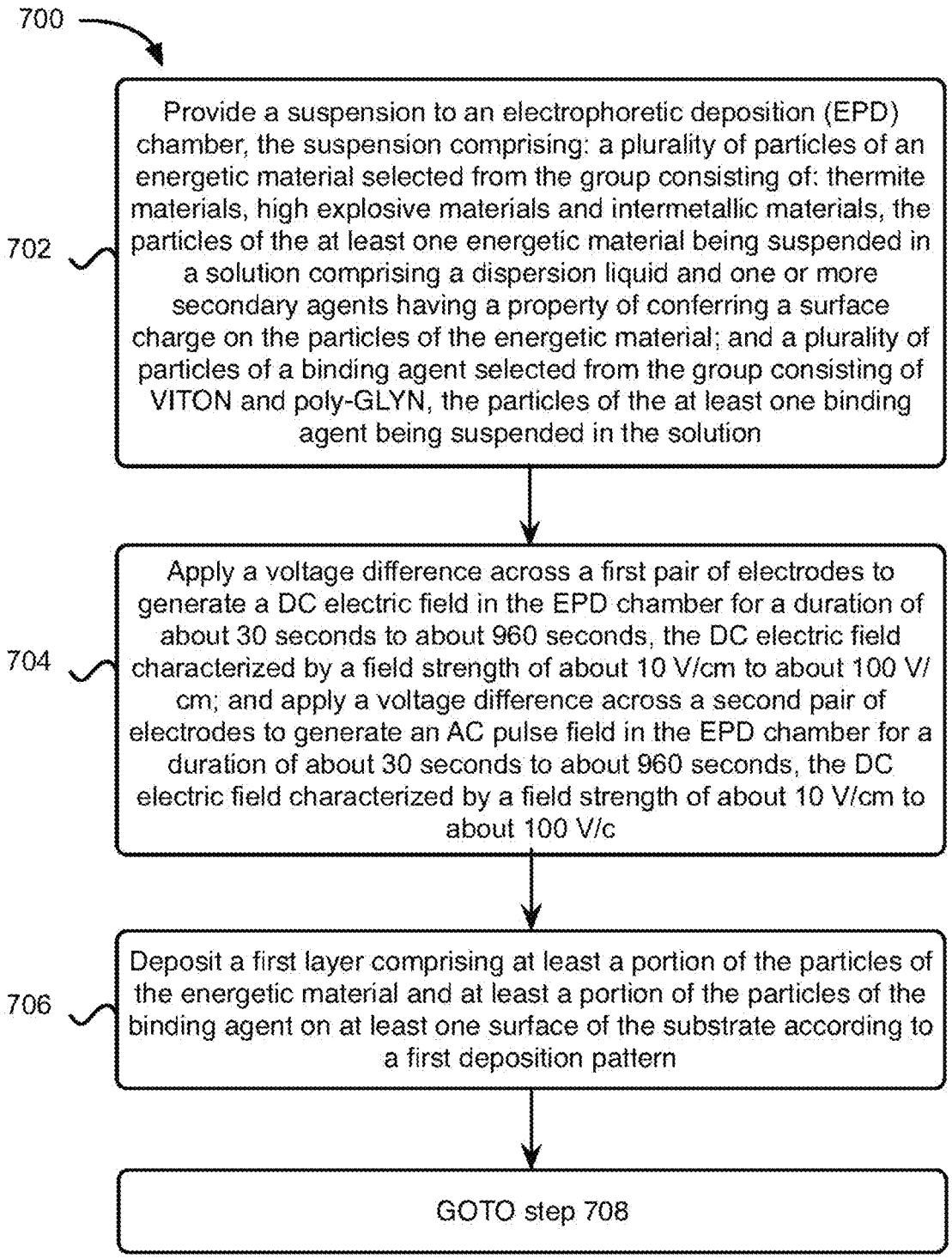
FIG. 7 shows a flowchart of a method, according to one embodiment.

Turning now to FIG. 7, a method 700 for forming an energetic material is shown according to one embodiment. The method 700 may be carried out in any desired environment, including those shown in FIGS. 1-5B, among others. As will be appreciated by a skilled artisan upon reading the descriptions below, method 700 represents one approach to depositing multiple layers of energetic material and binding agent particles onto a substrate surface in sequence. Of course, this approach is not limiting on the scope of the present disclosures, and alternative and/or additional approaches to depositing multiple particle layers may be employed without exceeding the scope of the present descriptions.

As shown in FIG. 7, method 700 includes operation 702, where, according to one embodiment, a suspension including particles of an energetic material are provided to an EPD chamber in a suspension including a solution of a dispersion liquid and one or more secondary agents, particles of an energetic material, and particles of a binding agent. In particular, the binding agent particles provided in operation 702 are either VITON or poly-GLYN particles.

In operation 704, a voltage difference is applied across a first pair of electrodes to generate a DC field in the EPD chamber. In particular, in some approaches the DC field is applied for about 30 seconds to 960 seconds at a field strength of about 1,000-10,000 V/m. Simultaneously, a voltage potential is applied across a second pair of electrodes to generate an AC pulse field in the EPD chamber. In particular, in some approaches the AC pulse field is applied for about 30 seconds to 960 seconds at a field strength of about 1,000-10,000 V/m.

During application of the electric fields, particles suspended in the EPD chamber are subjected to a net influence driving them toward the deposition surface of the substrate, and in operation 706 particles of energetic material and binding agent are codeposited on one or more surfaces of the substrate to form a first layer thereon, in one approach.

In further approaches, in operation 708 a second suspension including particles of an energetic material are provided to an EPD chamber in a suspension including a solution of a dispersion liquid and one or more secondary agents, particles of an energetic material, and particles of a binding agent. In particular, the binding agent particles provided in operation 708 are either VITON or poly-GLYN particles. The energetic material particles and/or binding agent particles provided in operation 708 may be identical to those provided respectively in operation 702, or alternatively may differ from the identity of the energetic material and/or binding agent particles provided in operation 702, in one exemplary instance.

Optionally, the suspension provided to the EPD chamber in operation 702 may be evacuated from the EPD chamber prior to providing the second suspension to the EPD chamber in some embodiments, although this evacuation is not necessary to perform method 700.

In one embodiment, in operation 710 a voltage difference is applied across the first pair of electrodes to generate a DC field in the EPD chamber. In particular, in some approaches the DC field is applied for about 30 seconds to 960 seconds at a field strength of about 1,000-10,000 V/m. Simultaneously, a voltage potential is applied across the second pair of electrodes to generate an AC pulse field in the EPD chamber. In particular, in some approaches the AC pulse field is applied for about 30 seconds to 960 seconds at a field strength of about 1,000-10,000 V/m.

During application of the electric fields, particles suspended in the EPD chamber are subjected to a net influence driving them toward the deposition surface of the substrate, and in operation 712 particles of energetic material and binding agent are codeposited on one or more surfaces of the substrate to form a second layer thereon, in one approach.

In embodiments where particles are deposited to form the first and/or second layers according to one or more deposition patterns, the second layer may completely or partially overlap (i.e. be deposited above) the first layer, and/or may be deposited directly onto the substrate surface(s), as will be appreciated by skilled artisans reading the present descriptions. In this manner, an example of one embodiment of a stacked structure including energetic materials and binding agent(s) may be fabricated using EPD methods.

EXPERIMENTAL RESULTS

While not intended to be limiting on the scope of the present disclosure in any manner, experimental results from exemplary tests evaluating the properties and behavior of energetic materials produced by an EPD process are provided herein for a better understanding of the subject matter of the present application.

Bend Test

Figure 8:
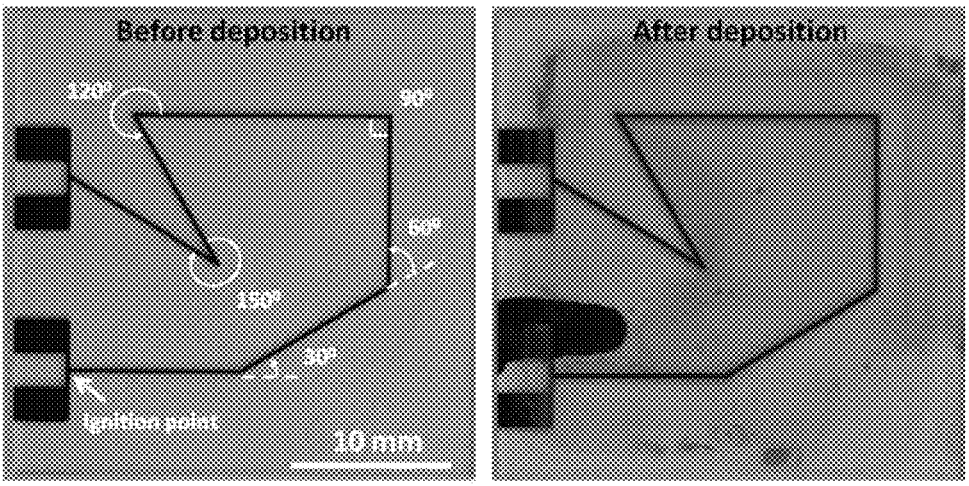
FIG. 8 is an image of a bend test experiment, according to one embodiment.

A bend test was designed to evaluate the ability of a propagating thermite to turn corners, and although it is mostly qualitative, is applicable where a non-linear pathway of propagation is desired in a device. For this experiment, the energetic material was ignited at a location near the edge, and then encountered a series of five turns, in 30° increments from 30-150°. Each path length before a turn was 10 mm to ensure a steady propagation would develop, except between the 90 and 1200 turn, which was designed to be longer in order to prevent strips from getting too close together. A schematic of the electrode before and after a deposition is shown in FIG. 8

Experimental results demonstrated that both the nano-Al and micro-Al thermites at their optimum equivalence ratios were able to turn all five corners and propagate to the end. However, one thing we did observe was that the flame can sometimes be seen to jump between strips as the flame approaches a turn. This jumping behavior will be discussed in the next section, and in general, only occurs for thicker deposits of film. Undesired jumping will change the transit time between ignition and when the flame reaches the desired location, and should be minimized in microenergetic applications Pitch Test A pitch test was designed to investigate the distance that thermites can jump and ignite an adjacent section of material. In some cases, this test can be used to determine minimum spacing requirements of adjacent thermite in a part. It was observed that thermites can undergo a transition from a conductive mode of energy propagation to one that includes a significant amount of particle advection. According to one theory, this behavior for thermites may have the potential to produce enough gas to overcome the material adhesion strength. Thus, if the pressure rises above some critical value, the material may undergo pressure unloading, and eject gases and particles at a high velocity. Analysis of advected particles indicated particle velocities nearly 2× faster than the flame velocity, indicating the particles may be responsible for a large amount of forward energy transport if they can encounter unreacted material.

A non-dimensional parameter (A) was developed based on a characteristic length scale (L), the effective diffusion coefficient of the produced gases (D), and the characteristic time scale of pressurization from the reaction ($\tau_p$), $A=L^2/(D*\tau p)$. For large values of A, gases are produced much faster than they can escape, and thus pressure builds within the material until a critical adhesion strength is breached. At this point, the material undergoes pressure unloading, which can enhance turbulence and eject particles at high velocities. The size of advected particles was found to be much larger (1-10 μm) than the starting particles (50-80 nm), and we hypothesized that this is because large particles have high Stokes numbers, thus allowing them to continue on linear trajectories and escape from the flame region.

The calculation of A relies on accurate measurements of what the gas produced is, along with the temperature, pressure, and pressure rise time. Fortunately, all of these parameters have been measured for nano-Al/CuO thermites, albeit using a range of experimental conditions. More details on the values and the references can be found in a previous work. In this experiment, it was not assumed that the value of A is accurately known, but instead film thickness was used to describe the relative value. L was defined as one half of the film thickness, and since A scales as $L^2$, it is expected that the transition is most sensitive to this parameter. Thus, it is possible to examine the jumping behavior as a function of the relative non-dimensional parameter, A, by changing the film thickness.

Figure 9:
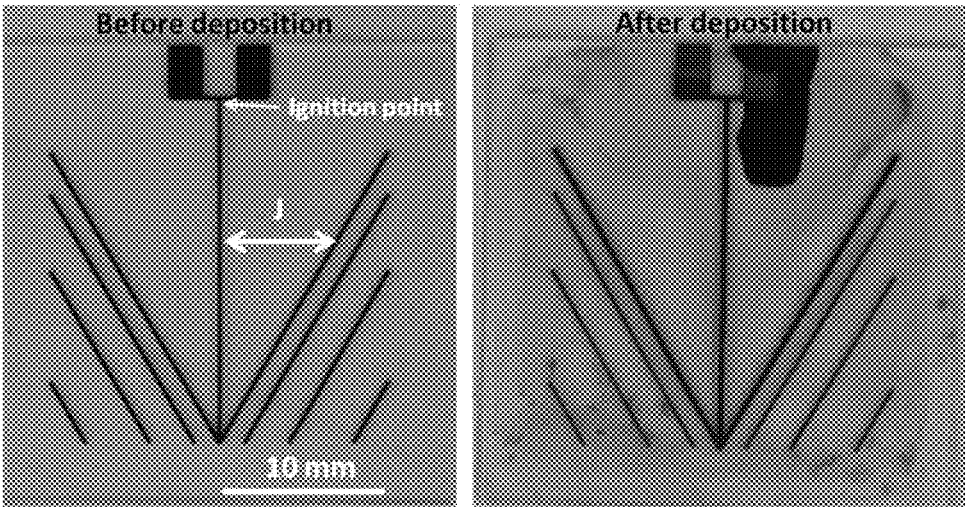
FIG. 9 is an image of a pitch test experiment, according to one embodiment.

The pitch electrode, and the defined jump distance "J", are shown before and after a deposition in FIG. 9. As oriented, a thermite was ignited at the top, and propagated down the central strip. At some point, advective transport occurred, and material from the central strip was be ejected and ignited the adjacent strips. The jump distance was be quantified, and an average value from the left and right pieces is reported. Extra patterned strips were intended to further probe jumping on parallel strips, but for this experiment they were not utilized and can be ignored. Material was only deposited on the central strip, and the two closest angled pieces.

While the nano-Al and micron-Al samples were expected to have different values for D and $\tau_p$, it was also expected that both systems would undergo a transition above some value of film thickness because of the $L^2$ dependence. From the pitch test of FIG. 9, it was observed that both nano-Al and micron-Al thermites were able to jump large distances (~10 mm) relative to their own dimensions (~500 microns).

In some cases, the advected material could be resolved in the images. Thus, the transit time may be used to approximate the particle velocity, assuming it is linear. This was feasible for the intermediate value of A, and the advected particles were approximated to have a velocity of 62 m/s, which was at least 2× the flame propagation velocity. In practical applications, the advected particles may have a distribution of velocities, and there may be some probability associated with the particles physically encountering unreacted material, which would govern whether a jump was successful or not.

Even though the width of a deposit was only several hundred micrometers, the pressure buildup and unloading was seen to eject hot clusters over distances at least two orders of magnitude larger. The maximum jump distance would ultimately be governed by the particle size and velocity (likely a function of material properties and internal pressure buildup), stopping distance in the ambient fluid, temperature, and also by the cooling rate. Even if a particle could jump several centimeters, it may cool below the ignition temperature, and therefore be unable to ignite unreacted material.

Drop Cast Versus EPD

In addition, some experiments indicated that controlled, ordered microstructures can dramatically increase the reactivity of materials when compared to materials created by other methods, such as drop-casting.

In one experiment, electrophoretic deposition (EPD) was employed as a facile and effective method to deposit binary energetic composites. In particular, micron-scale aluminum and nano-scale copper oxide were co-deposited as a thin film onto a conductive substrate without the use of surfactants. For comparative purposes, films of this energetic mixture were also prepared by drop-casting (DC) the premixed suspension directly onto the substrate, then allowing the liquid to dry. The structure and microscopic features of the two types of films were compared using optical and electron microscopies. The films prepared using EPD had an appreciable density of 2.6 g/cm$^3$, or 51% the theoretical maximum density, which was achieved without any further processing.

According to electron microscopy analysis, the EPD films exhibited much more uniformity in composition and film thickness than those produced by DC. Upon ignition, the EPD films resulted in a smoother and faster combustion event compared to the DC films. The dispersion stability was improved by adding water and decreasing the particle concentration, resulting in dispersions stable for more than 30 min, an ample amount of time for EPD. Patterned electrodes with fine feature sizes (20×0.25 mm) were then combined with EPD to deposit thin films of thermite for flame propagation velocity studies. The fastest velocity (1.7 m/s) was observed for an equivalence ratio of 1.6±0.2 (Al fuel rich composition). This peak value was used to investigate the effect of film mass/thickness on propagation velocity. The deposition mass was varied from 20 to 213 μg/mm$^2$, corresponding to a calculated range of film thicknesses from 9.8 to 104 μm. At lower masses, a flame did not propagate, indicating a critical mass (20 μg/mm$^2$) or thickness (9.8 μm). Over the range of thicknesses, in which self-propagating combustion was observed, the flame velocity was found to be independent of sample thickness. The lack of a thickness dependence suggests that under these particular conditions heat losses are negligible, and thus the velocity is predominantly governed by the intrinsic reactivity and heat transfer through the material.

In one embodiment, tests performed using energetic materials comprising nanocomposites, in particular metal-based ones, exhibited theoretical energy densities higher than that for monomolecular-based explosives, and high energy densities. Also, the gas producing capabilities of nanocomposite energetic materials were shown to range from near-zero to almost 100%, depending on the composition. The adiabatic temperatures for binary reactions exhibited a wide range of values, anywhere from a few hundred Kelvin to upwards of 10000 K, depending on whether phase changes were accounted for.

Figure 10:
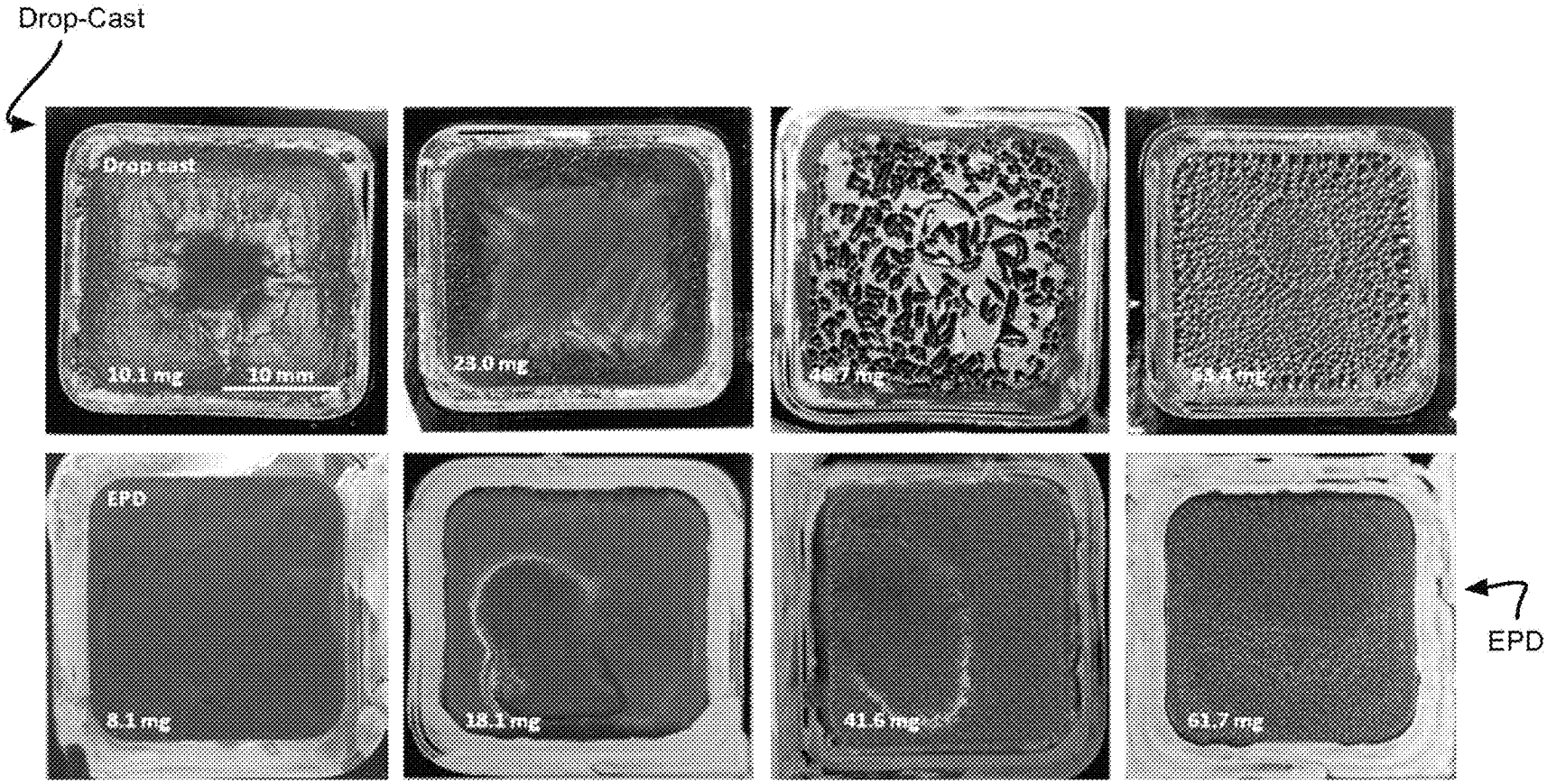
FIG. 10 shows optical microscopy images of energetic materials formed by drop casting (top row) and EPD (bottom row), according to one embodiment.

For one set of experiments, the dispersion was 1 vol. % solids loading in 100% EtOH, with an equivalence ratio of 1.0. However, this was a relatively unstable dispersion, which would settle in approximately 5 min and thus only allowed for using short deposition times. A comparison of optical micrographs of several drop cast and EPD films is shown in FIG. 10.

Those films prepared by drop casting exhibited poor homogeneity. Even on the millimeter scale, regions of heterogeneous discoloration can be seen, indicating a significant amount of bulk separation of the Al and CuO during the drying process. In some cases, the film cracked so much during the drying that it peeled off the surface completely, as can be seen in the 46.7 mg drop cast film (see FIG. 10).

On the other hand, films prepared by EPD exhibited much better film characteristics and uniformity. Regions of large-scale component separations were not observed optically, except that a light-colored residue could sometimes be seen on the surface. This residue likely forms during the drying step as the liquid recedes across the surface, and otherwise does not seem to have an effect on the film quality or combustion performance. Similar to the drop cast film, cracking can be observed in the EPD films, especially as the mass is increased. The EPD films could be handled and turned upside-down or vertically, on the substrate, indicating improved adhesion relative to the drop cast films. Adhesion is an important film quality in certain applications, particularly in microenergetics where the material may be ignited by a metallic film electro-thermal bridge, and good contact to the bridge is advantageous for thermal transfer during ignition.

Figure 11A:
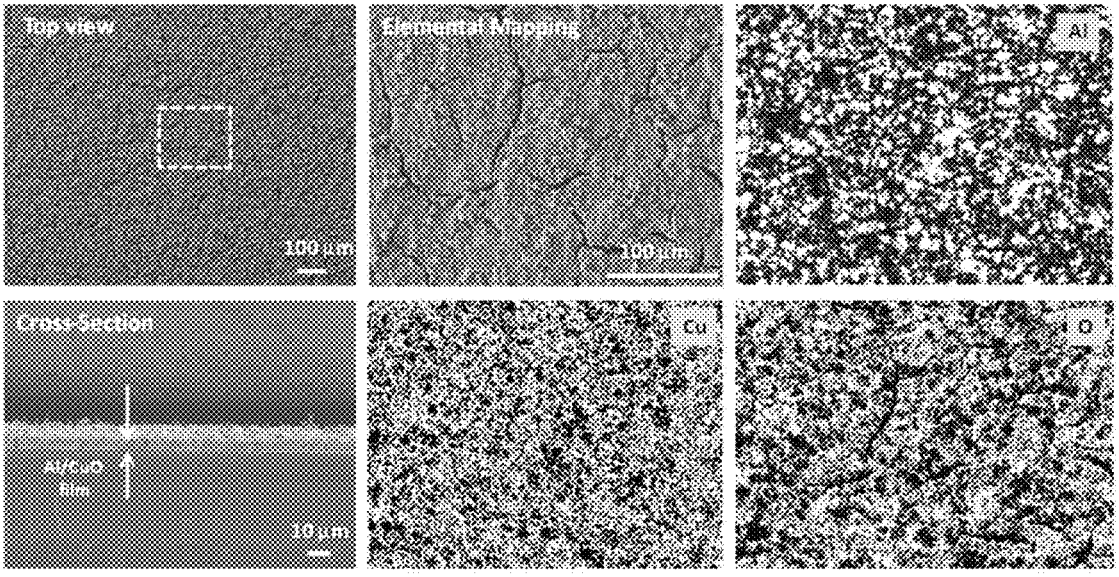
FIG. 11A shows SEM images of the top and cross-section of an energetic material formed by EPD, along with elemental mapping, for Al, Cu and O, according to one embodiment.

To examine the microstructure, select films were imaged using a scanning electron microscope. In order to eliminate effects from drying, two samples were prepared with comparable drying times (<5 min), corresponding to sample masses of 8.5 and 11.4 mg for drop cast and EPD, respectively. Scanning electron micrograph (SEM) images of the top and cross-section of the drop cast sample, along with elemental mapping, are shown in FIG. 11A. In these images, regions can be seen where the fuel and oxidizer are very poorly mixed, and appear to have separated by large length scales of several hundred microns.

It should be noted that upon scanning the rest of the area, regions were found which appear both more and less mixed than what is shown in FIG. 11A. In any case, the mixing is not homogeneous over the area of deposition. From the cross-sectional view, it can be seen that the film thickness is not uniform, and so determination of an accurate density was not feasible with this sample.

Figure 11B:
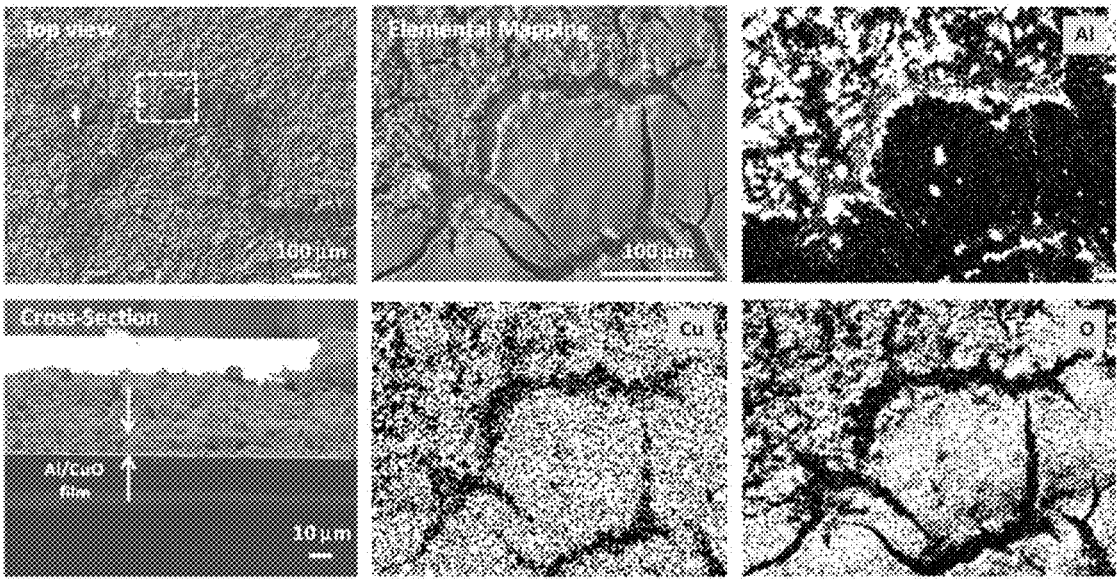
FIG. 11B depicts SEM images of the top and cross-section of a drop cast energetic material, along with elemental mapping, for Al, Cu and O, according to one embodiment.

As a comparison, SEM images of a film prepared by EPD are shown in FIG. 11B. The larger and more spherical Al particles can easily be distinguished from the much finer CuO, which appears as a uniform matrix material. When compared to the drop cast film, EPD produces much more homogeneously mixed and uniformly thick films. From the top view images, the Al particles can be seen as randomly scattered in the CuO matrix, with no locally unmixed regions apparent, as was the case with drop cast films. In the crosssectional view, the uniformity in film thickness is exemplified. These characteristics should serve to enhance the fuel/oxidizer interfacial contact, which can improve the reactivity by decreasing the characteristic mass transport length scale.

The equivalence ratio in the as-deposited film was examined as a function of the composition of the precursor dispersion. Different surface charging between Al and CuO can lead to different deposition rates, however, this can be adjusted for with a linear correction factor, assuming that the deposition rate scales linearly within the concentration range used. To examine this, the equivalence ratio for three samples was measured using ICP-OES (Φ). As expected, there was a linear translation with a coefficient of proportionality of 0.566 in this particular case. Using experiments such as these, and calculating a corresponding correction factor allows approximation of advantageous conditions for deposition in alternative systems and/or using alternative materials, in some approaches. It should be noted that the correction factor is system-dependent, and may become non-linear if a wider range of sample conditions are used.

Enhanced interfacial contact between the fuel and oxidizer has been shown by several authors to enhance the kinetics in energetic systems, and recent mechanistic studies of nano-Al thermites, and also carbon/CuO systems, have suggested the importance of condensed-phase interfacial reactions. To evaluate the compositional uniformity of the deposition over the area of the film (400 $mm^2$), two studies were done.

First, energy dispersive X-ray spectroscopy (EDS) was performed at several different locations (1 $mm^2$) on the film, and the measured ratio of Al/Cu was compared. The ratio was found to be similar regardless of what area data was collected from, ensuring compositional homogeneity in the film. While this analysis was appropriate to evaluate the spatial uniformity, EDS was not suitable as an accurate quantitative method to determine the mixture equivalence ratio. There are several factors which hinder this ability, such as particle size difference, surface roughness, aggregation, and volumetric scattering effects, to name a few.

For this reason, inductively coupled plasma-optical/atomic emission spectrometry (ICP-OES) was chosen for determination of the equivalence ratio of as-deposited films, and these results will be discussed later. The second study to evaluate the uniformity was to measure the film thickness at several locations across the area of deposition. To do this, the electrode was cleaved in half, and oriented in the SEM to image the cross-section. The film thickness was measured at several locations (average of 5 measurements per location) across the film, and was found to be uniform with less than 5% uncertainty, compared to >50% uncertainty in the film thickness observed in drop cast films (see FIG. 11B).

Next, the density of the EPD film was evaluated. From FIG. 11B, the average of twelve measurements of thickness was found to be 7.2 lm±0.4 μm. This corresponds to a density of 2.6 $g/cm^3$ for this particular deposit, without accounting for the small volume of voids from the film cracking. The theoretical maximum density (TMD) for stoichiometric Al/CuO is 5.1 $g/cm^3$, suggesting the EPD film is 51% TMD. However, the particle geometry should be accounted for when discussing the theoretical maximum density. For closely packed monodisperse spheres, the maximum achievable packing fraction is somewhere between 70% and 80% TMD, depending on the type of packing achieved. This value can be increased slightly if two different sizes of particles are used, and an optimum may be achieved for a specific ratio of particle diameters.

In cases where the particles each have a distribution of sizes, this will further affect the packing. Numerical modeling efforts have been used to examine packing assuming the particles have a Gaussian size distribution. Considering that there is a bimodal distribution of sizes, along with highly aggregated CuO, maximum packing density is expected to be well below the TMD of 5.1 $g/cm^3$. In other words, the particles appear to be packing to a reasonably high density, once the differences in size and morphology are accounted for. This high density is achieved without further particle processing, such as pressing or heating, and is another attractive feature of the EPD process.

As a preliminary evaluation of the combustion performance, several of the planar films were ignited, and the combustion event was recorded using a high-speed camera. The films were spark-initiated near the corner using a Tesla coil, and the combustion wave self-propagated to the opposite corner, with the deposited mass being 23.0 mg and 18.1 mg, respectively. From the combustion videos, the film prepared by EPD propagates nearly twice as fast and extends significantly farther upwards during the combustion. Furthermore, the combustion of the EPD film can qualitatively be described as a much smoother and uniform event, whereas this was not the case for the drop cast film.

As mentioned, the deposition thus far used a relatively unstable dispersion. While this still produced a well-mixed thermite film, which exhibited good combustion behavior, the dispersion stability was addressed to improve the reproducibility and make this technique more practical. One method to improve the stability is to enhance the surface charging, which in this case was done by adding water. Water has a high dielectric constant, which increases ion solvation and thus results in greater surface charging of dispersed particles.

Reaction Velocity

The flame velocity was evaluated as a function of equivalence ratio. The field strength was fixed at 40 V/cm for this set of film depositions. Since the Al:CuO ratio was changing, the deposition time varied to achieve the criterion that the deposited mass was 3.0±0.3 mg (1.0±0.1 mg/strip) so that equal masses could be compared. The width of the deposited material was measured using an optical microscope, and it was found to be larger than the width of the underlying Pt strip (250 μm). This is attributed to the deposition behavior of material onto fine-featured electrodes. Due to the converging electric field lines, material not only deposits on top of the Pt, but also laterally.

Figure 12:
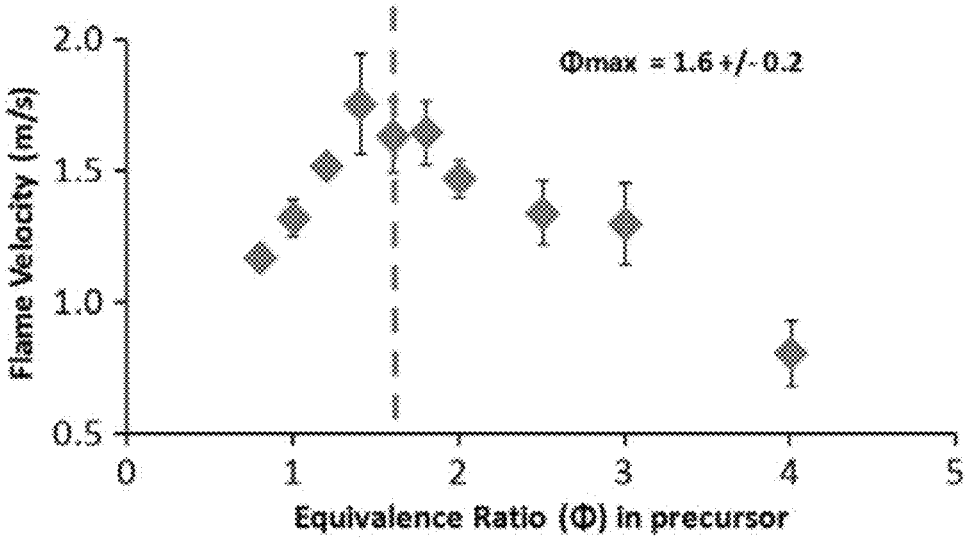
FIG. 12 is a graph showing the relationship between flame velocity and equivalence ratio, according to one embodiment.

The results of the combustion velocity as a function of equivalence ratio are plotted in FIG. 12, and indicate that the peak velocity (approximately 1.7 m/s) was observed at an equivalence ratio between 1.4 and 1.8. Given the uncertainty in the measurements, the estimated peak was at U=1.6, with an uncertainty of 0.2 in this value.

To determine the actual equivalence ratio at this peak value, elemental analysis using ICP-OES (Al and Cu levels measured) was performed for a sample deposited under identical conditions onto a patterned electrode. According to the elemental analysis, samples prepared from a dispersion whose equivalence ratio was U=1.6 resulted in a film with a measured equivalence ratio of 1.63 after deposition. Several other deposition conditions were explored, and their equivalence ratio's compared to that in the precursor deposition dispersion. The results of this analysis are summarized in Table 1, below.

| Electrode type | Field strength (V/cm) | Deposition time (min) | Φ weighed | Φ measured by ICP-OES | Uncertainty (%) |
|---|---|---|---|---|---|
| Patterned | 40 | 2 | 1.6 | 1.63 | 2.0 |
| Planar | 40 | 2 | 1.6 | 1.68 | 4.7 |
| Planar | 40 | 16 | 1.6 | 1.40 | 14.6 |
| Planar | 10 | 2 | 1.6 | 1.42 | 12.9 |
| Planar | 100 | 2 | 1.6 | 1.81 | 11.7 |

Over the range of deposition conditions used, it can be seen that the equivalence ratio in the precursor dispersion translates relatively well into that in the deposited film. Other authors have observed that a nanocomposite of Al/CuO has an optimum reactivity near an equivalence ratio of 1.0, where the gas production and temperature are calculated to be the highest. The value of 1.6 measured in this work cannot be explained by either temperature or gas production. However, the prepared films are relatively dense, and use micron-sized Al. Furthermore, with measured flame velocities of <2 m/s, it is expected that the mode of energy propagation is dominated by conduction, or possibly via particle advection. Advection has received little attention in such formulations but experimental observations noted bright clusters being ejected in all directions, and in many cases much faster than the flame velocity.

This analysis assumed monodisperse spherical particles, and the packing was calculated using physical properties and the mixture composition. In many cases, the optimal interfacial contact occurs for fuel-rich conditions, and shows some correlation with burning rate for certain pyrotechnic mixtures examined While it is expected that interfacial contact improves as the mixture becomes fuel-rich, the temperature and gas production simultaneously decrease. Ultimately, this tradeoff may govern the exact value of the optimum equivalence ratio for a given energetic material.

Figure 13:
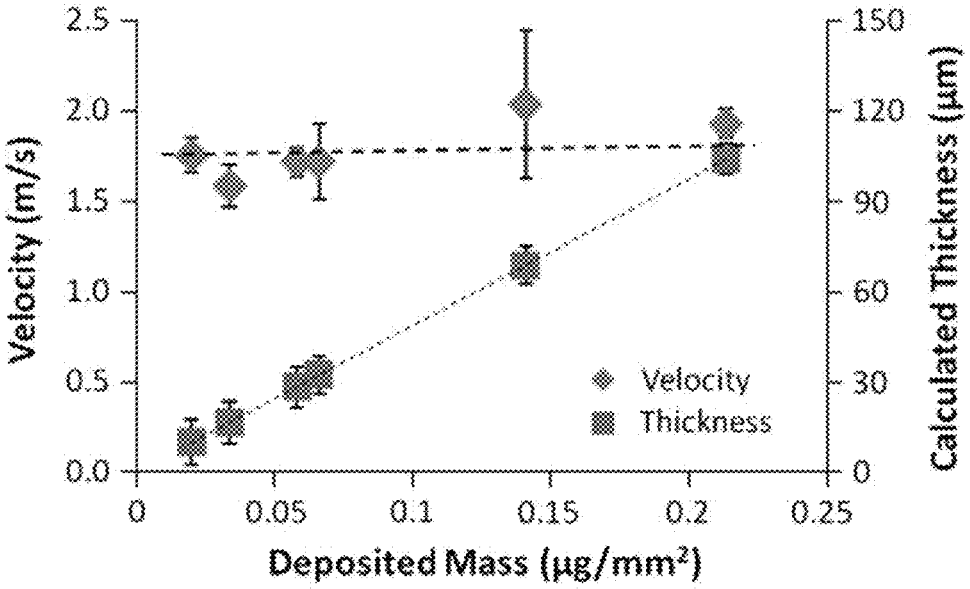
FIG. 13 depicts a graph showing the relationship between combustion velocity, deposited mass, and film thickness, according to one embodiment.

Using an optimum equivalence ratio of 1.6, the effect of deposition mass/thickness on propagation velocity was evaluated. The deposited mass was varied from 0.1 to 2.1 mg/strip, which corresponded to an area density of 20-213 $\mu g/mm^2$. This was accomplished by changing the applied field from 40 to 100 V/cm, and the deposition time from 10 to 105 s. The width of the deposition was measured using an optical microscope. Using a packing density of 2.6 $g/cm^3$, and assuming the deposit cross-section is rectangular, the thickness of the deposition can be estimated using the mass and measured width. The calculated film thicknesses ranged from 9.8 to 104 μm, and the flame velocity as a function of the deposited mass and thickness is plotted in FIG. 13. Unexpectedly, there was no observed effect of deposition mass or thickness on propagation velocity in the range used in this study. Two additional samples were prepared using deposition times of 10 s and field strengths 20 and 10 V/cm, corresponding to films with <20 $\mu g/mm^2$ of mass.

For the given composite burning unconfined in air, it was determined that, in one embodiment the critical mass to support a self-propagating flame was 0.13 mg/strip, corresponding to an area density of 20 $\mu g/mm^2$, and a calculated film thickness of 9.8 μm.

For films between ~10-50 μm thick, a slowly propagating flame with a velocity of approximately 4 m/s was observed. Between ~50-120 μm thick, we observed a nearly linear increase in velocity as the thickness was increased. Above approximately 120 μm, another plateau was observed, with an average velocity almost a factor of 10 higher. This sort of behavior is not necessarily attributed to the intrinsic kinetics of the reaction, but instead likely indicates a shift in the mechanism of energy transport.

Experimental observations also revealed that higher thickness may result in cracking of the film perpendicular to the plane of deposition. This film cracking behavior was quite different as the deposition thickness increased. For small thicknesses, no visual cracking could be resolved. However, for thicker deposits, the film exhibited larger, more regular cracking in a direction perpendicular to the flame propagation velocity. This is important to mention because the cracking may have some positive effect on energy transport, by allowing conduits for gas and particle transport. The coupling of microstructure and reaction propagation is something which has only recently been observed in such formulations.

Flames corresponding to a slow velocity appear to have qualities of a conductive mode of energy transport, while fast flames exhibit more turbulent behavior and particle ejection. Without wishing to be bound to any particular theory, the inventors posit that nanocomposites may transition into a convective mode of energy propagation. Despite a few exceptions, the discussion of particle advection has been very limited. One problem is that it's difficult to experimentally distinguish between the two modes, since both should be aided by gas production.

The fact that the flame velocity reaches a plateau value and becomes independent of mass seems to indicate that heat losses become negligible immediately above the critical mass, which was not expected a priori. Considering that one embodiment is a packed bed of particles, it likely exhibits poor conductive heat transfer to the substrate. Since the reaction is not confined, without wishing to be bound to any particular theory, the inventors speculate that intermediate gas is rapidly formed to convect and/or advect the material away from the substrate.

Material Deposition

The deposited mass was also investigated as a function of the applied field strength and deposition time. The field strengths for this study were 10, 40 and 100 V/cm, and times ranged from 0.5 to 16 min. The data is presented in FIGS. 14 and 15; as a function of deposition time and as a function of field strength, respectively. For a given field strength, it can be seen that the data scales logarithmically with time. Several other authors have observed a similar behavior for a fixed field strength, where the deposition mass is linear at short times and plateaus for prolonged times. This behavior occurs when an insulating film is being deposited, which decreases the effective electric field strength transiently.

Figure 14:
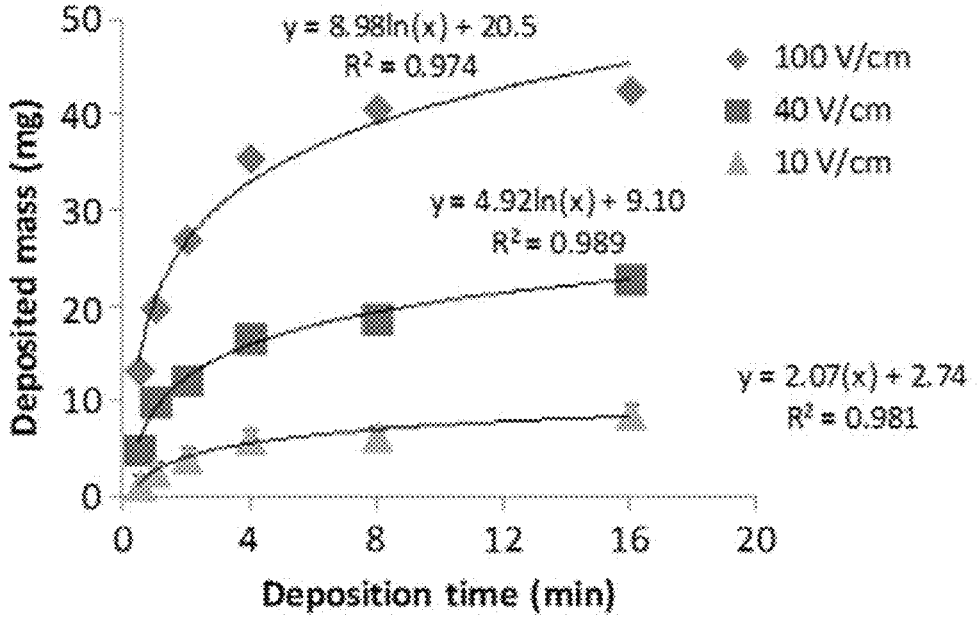
FIG. 14 is a graph showing the relationship between deposited mass and deposition time.
Figure 15:
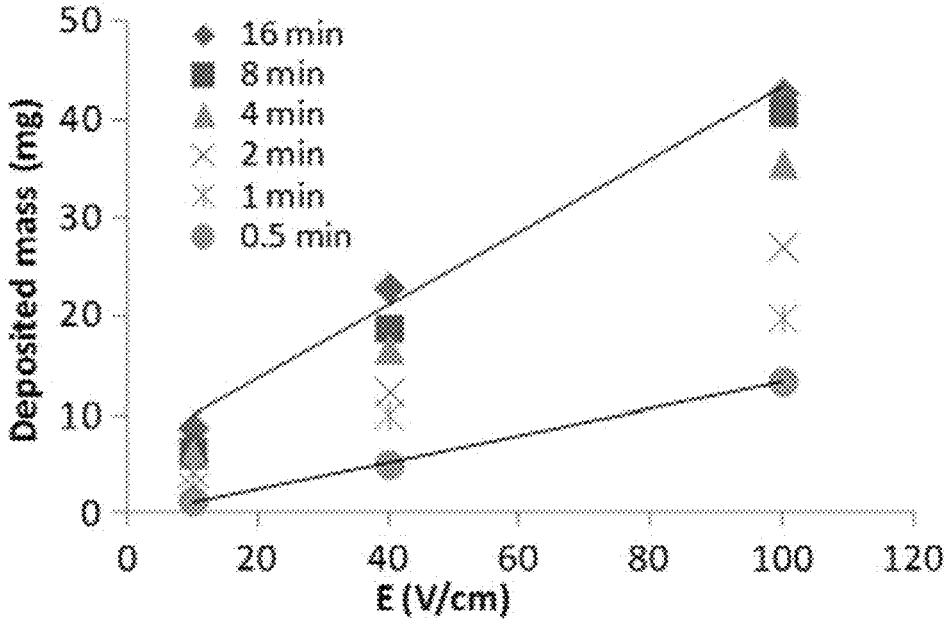
FIG. 15 is a graph showing the relationship between deposited mass and field strength during electrophoresis.

From FIGS. 14 and 15, it can be seen for a fixed time, the deposited mass scales linearly with field strength. This occurs because particle packing during EPD is a kinetically-driven process, and using too high a field strength will drive particles to the surface at an increased rate. This can affect the particle packing and film quality by not allowing the particles sufficient time for surface mobility to find their best place to sit for dense packing. These results exemplify both the reproducibility and control of using EPD to deposit well-mixed energetic composite films. These attributes directly translate into the energy release characteristics of such films, thus making EPD useful for applications as well as mechanistic investigations.

Uses and Applications

The materials and methods of fabrication thereof described herein are useful in a wide variety of applications, as described herein. In use, energetic materials deposited by electrophoretic processes generally are characterized by self-propagating reactions upon ignition, which may be initiated in any suitable manner, including by spark, flame, electrostatic discharge, friction, impact, etc. as would be understood by one having ordinary skill in the art upon reading the present descriptions. Preferable ignition methods may vary according to the energetic material and/or the application to which the energetic material is directed.

As the embodiments described herein demonstrate, the EPD methods and structures formed through the EPD methods disclosed herein, according to various embodiments, may be used for any number of novel materials and structures. According to some embodiments, the structures and methods may be used for applications including: 1) protecting sensitive information and/or data by providing means for destroying materials containing such information and/or data, for example by including remote detonation and/or ignition capabilities via energetic materials deposited on and/or in documents, recording media, communication devices, etc.; 2) materials joining for a wide variety of industrial applications including mining, machining, railway construction, etc.; 3) controlled ignition and/or detonation devices, such as delayed detonation fuses for application in defense, law enforcement, and/or mining, etc.; 4) space exploration, e.g. facilitating controlled thrust via precise fuel formulations with highly predictable ignition and burn behavior and/or by reducing fuel contribution to total payload at launch; 5) pyrotechnics.

In one particular application, particularly for protecting sensitive information, a system including a circuit and/or memory device and an energetic material deposited therein by an EPD process is configured for disabling the circuit and/or memory upon igniting the energetic material. As understood herein, systems such as the circuit and/or memory described above may be disabled by complete or partial destruction of the circuit and/or memory, disrupting one or more components of the circuit and/or memory, or any other manner of rendering the circuit and/or memory unusable, as would be understood by one having ordinary skill in the art upon reading the present descriptions.

Figure 16A:
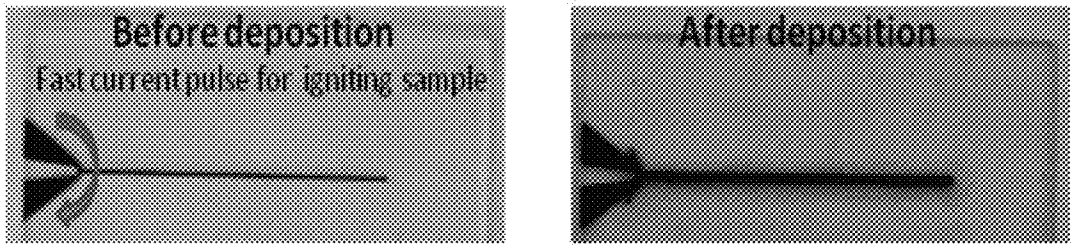
FIG. 16A shows a planar electrode configuration for employment as a delayed ignition device, according to one embodiment.

In another particular application, particularly for providing controlled and/or delayed ignition, detonation, etc. such as shown in FIG. 16A where EPD was employed to deposit an energetic material onto a planar linear electrode. In this embodiment, the energetic material may be ignited, e.g. by flame, spark, friction, impact, etc. and the ignition delay to reach an arbitrary second point may be tuned and/or controlled by parameters such as the strip length, width, material, reactivity, etc. as would be understood by one having ordinary skill in the art upon reading the present descriptions.

Figure 16B:
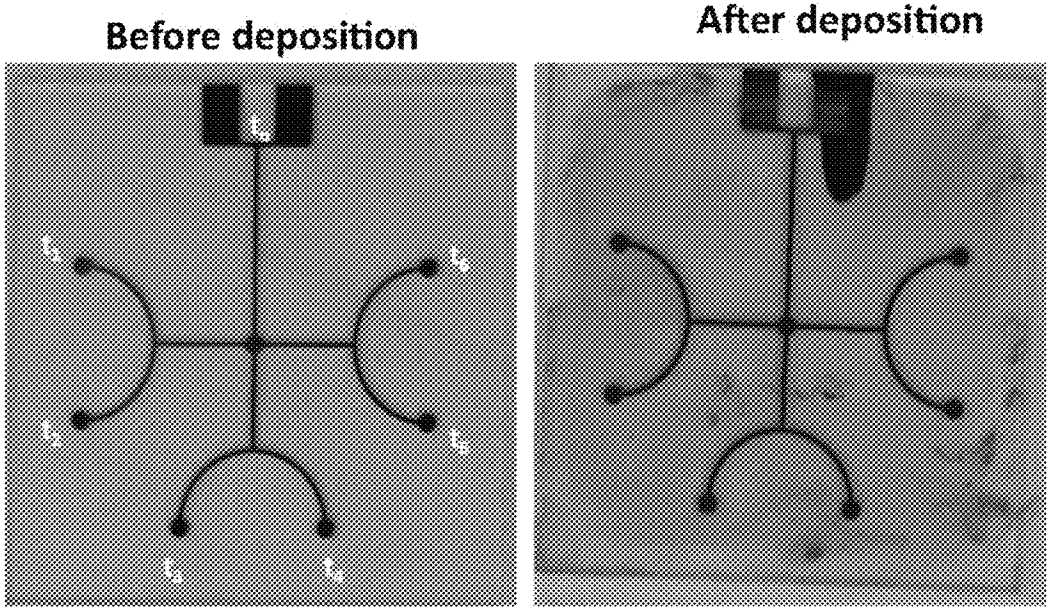
FIG. 16B shows a planar electrode configuration for employment as a delayed ignition device, according to one embodiment.

In another configuration, such as the exemplary embodiment shown in FIG. 16B, energetic material(s) deposited by EPD may be ignited in one location and subsequently split into a plurality of channels to achieve multi-point ignition. As shown in FIG. 16B, the configuration includes six equidistant channels.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method, comprising:

providing a plurality of particles of an energetic material suspended in a dispersion liquid to an electrophoretic deposition (EPD) chamber or configuration;

applying a voltage difference across a first pair of electrodes to generate a first electric field in the EPD chamber;

applying a voltage difference across a second pair of electrodes to generate a second electric field in the EPD chamber, wherein the first electric field is different from the second electric field, wherein the first electric field is characterized as a pulse field; and depositing at least some of the particles of the energetic material on at least one surface of a substrate, the substrate being one of the electrodes or being coupled to one of the electrodes.

2. The method as recited in claim 1, wherein evacuating the dispersion liquid from the EPD chamber is performed at a rate of approximately 2 mL/min.

3. The method as recited in claim 1, further comprising depositing at least a portion of a plurality of particles of a binding agent above the at least one surface of the substrate, wherein particles of at least one binding agent are suspended in the dispersion liquid during deposition thereof, and wherein the particles of the binding agent having a property of enhancing adhesion of the particles of the energetic material to one another and/or the at least one surface of the substrate.

4. The method as recited in claim 1, wherein the energetic material is selected from the group consisting of: thermites, high explosive materials, and intermetallic materials.

5. The method as recited in claim 1, wherein generating the first electric field comprises generating either a direct-current (DC) field or an alternating-current (AC) field.

6. The method as recited in claim 1, wherein the first electric field is characterized as a pulse field.

7. The method as recited in claim 6, wherein the pulse field is characterized by a shaped pulse.

8. A method comprising:

providing a plurality of particles of an energetic material suspended in a dispersion liquid to an EPD chamber or configuration;

applying a voltage difference across a first pair of electrodes to generate a first electric field in the EPD chamber;

depositing at least some of the particles of the energetic material on at least one surface of a substrate, the substrate being one of the electrodes or being coupled to one of the electrodes; and using a second electrode pair for generating a second electric field in the EPD chamber, the second electrode pair comprising:

a third electrode positioned in a third location in the EPD chamber; and a fourth electrode positioned in a fourth location substantially opposite the third electrode.

9. The method as recited in claim 8, wherein generating the first electric field is performed simultaneous to generating the second electric field.

10. The method as recited in claim 9, the first pair of electrodes comprising a first electrode and a second electrode, wherein a first line intersecting the first electrode and the second electrode is substantially perpendicular to a second line intersecting the third electrode and the fourth electrode, and wherein generating the first electric field and generating the second electric field comprises generating electric fields having substantially perpendicular axes of orientation.

11. The method as recited in claim 10, wherein generating the first electric field comprises generating a DC field, and wherein generating the second electric field comprises generating an AC pulse field.

12. The method as recited in claim 1, wherein the substrate comprises a nanoporous material.

13. The method as recited in claim 1, wherein the substrate comprises a nonconductive structure functional to participate in an energetic reaction of the energetic material.

14. The method as recited in claim 13, wherein the nonconductive structure is porous.

15. A method, comprising:

providing a suspension to an EPD chamber or configuration, the suspension comprising:

a plurality of particles of at least one energetic material selected from the group consisting of: thermite materials, high explosive materials and intermetallic materials, the particles of the at least one energetic material being suspended in a solution comprising a dispersion liquid and one or more secondary agents having a property of conferring a surface charge on the particles of the energetic material; and a plurality of particles of at least one binding agent selected from the group consisting of VITON and poly-GLYN, the particles of the at least one binding agent being suspended in the solution;

applying a voltage difference across a first pair of electrodes to generate a DC electric field in the EPD chamber for a duration of about 30 seconds to about 960 seconds, the DC electric field characterized by a field strength of about 1,000 V/m to about 10,000 V/m;

applying a voltage difference across a second pair of electrodes to generate an AC pulse field for a duration in a range from about 30 seconds to about 960 seconds, the AC pulse field characterized by a field strength of about 10 V/cm to about 100V/cm;

depositing a first layer comprising at least a portion of the particles of the energetic material and at least a portion of the particles of the binding agent on at least one surface of a substrate according to a first deposition pattern;

providing a second suspension to the EPD chamber, the second suspension comprising:

a plurality of particles of a second energetic material selected from the group consisting of: thermite materials, high explosive materials and intermetallic materials, the particles of the at least one energetic material being suspended in a second solution comprising a second dispersion liquid and one or more secondary agents having a property of conferring a surface charge on the particles of the second energetic material; and a plurality of particles of a second binding agent selected from the group consisting of VITON and poly-GLYN, the particles of the at least one binding agent being suspended in the second solution;

applying a voltage difference across the first pair of electrodes to generate the DC electric field in the EPD chamber for a duration in a range from about 30 seconds to about 960 seconds, the DC electric field characterized by a field strength of about 1,000 V/m to about 10,000 V/m;

applying a voltage difference across the second pair of electrodes to generate the AC pulse field for a duration in the range from about 30 seconds to about 960 seconds, the AC pulse field characterized by a field strength of about 10 V/cm to about 100V/cm; and depositing a second layer comprising at least a portion of the particles of the second energetic material and at least a portion of the particles of the second binding agent on at least one surface of the substrate according to a second deposition pattern, wherein a first line intersecting the first pair of electrodes is substantially perpendicular to a second line intersecting the second pair of electrodes, wherein generating the DC electric field is performed simultaneous to generating the AC pulse field, and wherein generating the DC electric field and generating the AC pulse field simultaneously comprises generating electric fields having substantially perpendicular axes of orientation.

16. The method as recited in claim 1, wherein the substrate is coupled to one of the electrodes.

17. The method as recited in claim 1, wherein at least one secondary agent is added to the suspension of particles of the energetic material in the dispersion liquid.

18. The method as recited in claim 17, wherein the at least one secondary agent and at least some of the particles of the energetic material are codeposited on the at least one surface of the substrate at about a predefined ratio.

19. The method as recited in claim 17, wherein the at least one secondary agent is selected from the group consisting of: polymers and organic molecules.

20. The method as recited in claim 17, wherein the at least one secondary agent has a property of conferring a surface charge on the at least some of the particles of the energetic material.

* * * * *